United States Patent [19]

Sainte et al.

[11] Patent Number: 5,064,193

[45] Date of Patent: Nov. 12, 1991

[54] AUTOMATIC FORCE GENERATING AND CONTROL SYSTEM

[75] Inventors: Robert L. Sainte, Winchester, Ky.; Steven E. Sarns, Arvada; Steven R. Frank, Golden, both of Colo.

[73] Assignee: Walker Fitness Systems, Inc., Reston, Va.

[21] Appl. No.: 439,932

[22] Filed: Nov. 13, 1989

[51] Int. Cl.[5] ..... A63B 21/008

[52] U.S. Cl. ..... 272/130

[58] Field of Search ..... 272/129, 130, 134

[56] References Cited

U.S. PATENT DOCUMENTS

| | | | |
|---|---|---|---|
| 3,128,094 | 4/1964 | Wolf | 272/130 |
| 3,164,325 | 1/1965 | Veum . | |
| 3,495,824 | 2/1970 | Cuinier . | |
| 4,183,520 | 1/1980 | Chase . | |
| 4,227,689 | 10/1980 | Keiser . | |
| 4,235,437 | 11/1980 | Ruis et al. | 272/134 |
| 4,241,913 | 12/1980 | Zwater et al. | 272/130 |
| 4,247,098 | 1/1981 | Brentham . | |
| 4,254,949 | 3/1981 | Brentham . | |
| 4,258,913 | 3/1981 | Brentham . | |
| 4,275,882 | 6/1981 | Grosser et al. . | |
| 4,326,707 | 4/1982 | Strecker . | |
| 4,354,676 | 10/1982 | Ariel . | |
| 4,357,010 | 11/1982 | Telle . | |
| 4,363,481 | 12/1982 | Erickson . | |
| 4,397,462 | 3/1983 | Wilmarth | 272/130 |
| 4,441,708 | 4/1984 | Brentham . | |
| 4,448,412 | 5/1984 | Brentham . | |
| 4,452,447 | 6/1984 | Lepley et al. . | |
| 4,478,412 | 10/1984 | Muir . | |
| 4,482,152 | 11/1984 | Wolff . | |
| 4,544,154 | 10/1985 | Ariel . | |
| 4,601,468 | 7/1986 | Bond et al. . | |
| 4,609,190 | 9/1986 | Brentham . | |
| 4,667,955 | 5/1987 | Giesch . | |
| 4,705,271 | 11/1987 | Mondloch et al. . | |
| 4,711,450 | 11/1987 | McArthur . | |
| 4,722,525 | 2/1988 | Brentham . | |
| 4,746,115 | 5/1988 | Lahman . | |
| 4,799,676 | 1/1989 | Sheppard et al. . | |
| 4,801,139 | 1/1989 | Vanhoutte et al. . | |
| 4,830,362 | 5/1989 | Bull . | |
| 4,846,458 | 7/1989 | Potts . | |
| 4,846,466 | 7/1989 | Stima . | |
| 4,848,739 | 7/1989 | Schaub et al. . | |
| 4,863,161 | 9/1989 | Telle . | |
| 4,865,315 | 9/1989 | Paterson et al. . | |
| 4,872,668 | 10/1989 | McGillis et al. . | |

*Primary Examiner*—Robert Bahr

*Attorney, Agent, or Firm*—Dickstein, Shapiro & Morin

[57] ABSTRACT

An automatic force generating and control system that automatically sets exercise forces in accordance with user programmed criteria and is capable of providing pressurized flow to both ends of the arm hydraulics and leg exerciser hydraulics. Anticavitation is provided during idling, pressurized flow and when the user is successfully overcoming the pressurized flow. In the preferred embodiment, pressure is regulated by two proportional pressure relief valves which set the pilot pressure of the control valves and switching elements which direct the pressurized flow to the hydraulics. In an alternate embodiment pressure and flow are regulated by a bi-directional pump through the current and voltage sent to the pump by the controls. In a third embodiment the pressure is regulated by a proportional pressure relief valve which is connected in parallel to the ends of either the arm cylinders and to a uni-directional pump. In the alternate embodiments anticavitation is provided by a double pilot operated check valve.

39 Claims, 36 Drawing Sheets

AUTOMATIC FORCE GENERATING AND CONTROL SYSTEM

BACKGROUND OF THE INVENTION

This invention relates to an automatic force generating and control system and, in particular, a hydraulic system for an automatic force generating and control system.

As exercise is becoming an increasingly important part of our daily routine, the demand for quality exercise machinery has become more pronounced. A particular focus for this demand centers on weight lifting machines that enable a user to achieve a total workout in a small amount of space.

Because many users have a limited amount of space in their own homes or apartments or, for that matter, at their exercise facilities, those users must be concerned with locating as much equipment as possible into smaller spaces. The attainment of these objectives poses certain problems when examining currently available exercise devices.

First, the compact designs, such as the stacked-weight system, employ cable connected weights that move along rails or bars. When more than one user is exercising, however, the weights will often drop suddenly causing the device to jerk and move. Those movements in the weights will often disturb the concentration of others, and occasionally result in injuries.

An additional disadvantage to the stacked-weight system is its lack of flexibility. Each station in such a device is primarily restricted to one or possibly two exercises. To work out the entire body, therefore, a user must rotate around to multiple stations. A total workout thus requires between eight to ten changes of location. To pace his/her workout accordingly the user must be assured that these stations remain free. When the universal machine is crowded with multiple users, such a workout can be difficult, if not impossible.

A further problem with stacked-weight systems is the generation of force on the return stroke. Stacked and free weight systems do not allow the return force to be set substantially higher than the force setting for the initial stroke. However, the muscoskeletal system yields more effective results from the point of strength gain when a higher force setting is set on the return stroke. Accordingly, conventional resistance machines using dead weights have an inherent design deficiency from the perspective of exercise efficiency.

A further disadvantage of the current exercise equipment is their lack of ability to customize the start and finish of an exercise stroke to the physical properties of the user. Specifically, the current machines are designed for one individual of a particular size. Larger individuals may be cramped while smaller individuals may be strained and perhaps totally unable to position themselves properly with respect to the equipment. Further, the start point for each exercise cannot be varied. Thus, each user is required to start the exercise stroke at the same start point regardless of whether this start point is comfortable. This enforced uniformity may injure or unnecessarily tire the user because the user may be required to exercise during some portion of the stroke which is not appropriate for the user's particular physique. Conventional weight machines do not allow the user to configure the machine to his/her individual physique and move the equipment under minor resistance to the start position most comfortable to the user before initiating resistance to movement.

A further disadvantage to the present weight lifting systems is their lack of personalized control. With the advent of computers and electronic control systems, there exists a need for a progressive resistance system that can store the force profiles of its users and tailor the exercise routines in accordance with those profiles. Thus, the person who wishes to use a machine for keeping count of his or her repetitions, for calculating a progressively challenging regime, or for visually and audibly prompting his/her exercises, can be served by a machine that takes advantage of these technologies.

An additional need by users of weight lifting systems is motivation. Over the course of a workout, the user needs a way to set exercise goals and providing motivational feedback messages. Goals take the form of allowing the use to set work-out targets that are both short term and long term in nature. Feedback can include visual indications of the workout that allow the user to track his/her range of motion, clock the length of the workout, and provide cumulative ratings of the exercise results. Feedback can also include audio motivation such as counting repetitions, audio precautions, printouts of various exercise related data, and congratulatory statements.

Finally, there is an important need to provide safety for the exerciser. A free weight system relies on an extra person to "spot" the weight lifter. If the user is alone, however, he often risks injury. Thus, a need exists for a system that contains safety features without demanding the presence of an extra person. Moreover, there is a need for a safety device which prevents children or unauthorized people from using the system without permission.

SUMMARY AND OBJECTS OF THE INVENTION

It is therefore, an object of this invention to overcome the above-described deficiencies by providing an automatic force generating and control system comprising a compact, multi-purpose hydraulic system that automatically sets exercise forces to the pivoting members of the exercise machine in accordance with user-preprogrammed criteria. The hydraulic system varies the force between exercises and even during a single stroke in response to signals from the electronic controls. The hydraulic system can provide pressurized flow to either side of the arm hydraulics and the lower body exerciser hydraulics. Further, the hydraulic system has anticavitation systems for both sides of the arm hydraulic and lower body exerciser hydraulics under pressure and when idling.

It is a further object of this invention to provide an exercise machine positioning system.

It is an additional object of this invention to provide an exercise machine pressurizing system.

It is yet another object of this invention to provide an exercise machine pressure varying system.

These objects are provided for in an automatic force generating control system which includes a hydraulic system with two proportional pressure relief valves, which when activated, direct flow to either side of the arm or lower body exerciser hydraulics. The amount of current directed to the proportional pressure relief valves determines the pressure setting of the control valves and switching elements which direct the pressurized flow. A solenoid valve directs the pressurized flow to either the arm hydraulics or the lower body exerciser hydraulics. The anticavitation is provided by the control valves and check valves which are unseated by the return flow.

These objects are further realized by an automatic force generating and control system which consists of a bi-directional pump which can be connected to either side of the arm or lower body exerciser hydraulics. The amount of pressure and quantity of flow to the hydraulics is selected by the electronic controls in the form of the amount of current and voltage sent to the pump. Anticavitation is provided by a double pilot operated check valve which is connected in parallel with the pump to a reservoir.

The present invention is further realized in an automatic force generating and control system which includes a uni-directional pump and a proportional pressure relief valve which is connected in parallel to both sides of either the arm or lower body exerciser hydraulics. The side of the hydraulics to which the proportional pressure relief valve is connected is determined by solenoid operated control valves which receive their signals from the electronic control. Further, the amount of pressure directed to the hydraulics is determined by the amount of current directed to the proportional pressure relief valve. Anticavitation is provided by a double pilot operated check valve.

DETAILED DESCRIPTION OF THE PREFERRED EMBODIMENT

Figure 1:
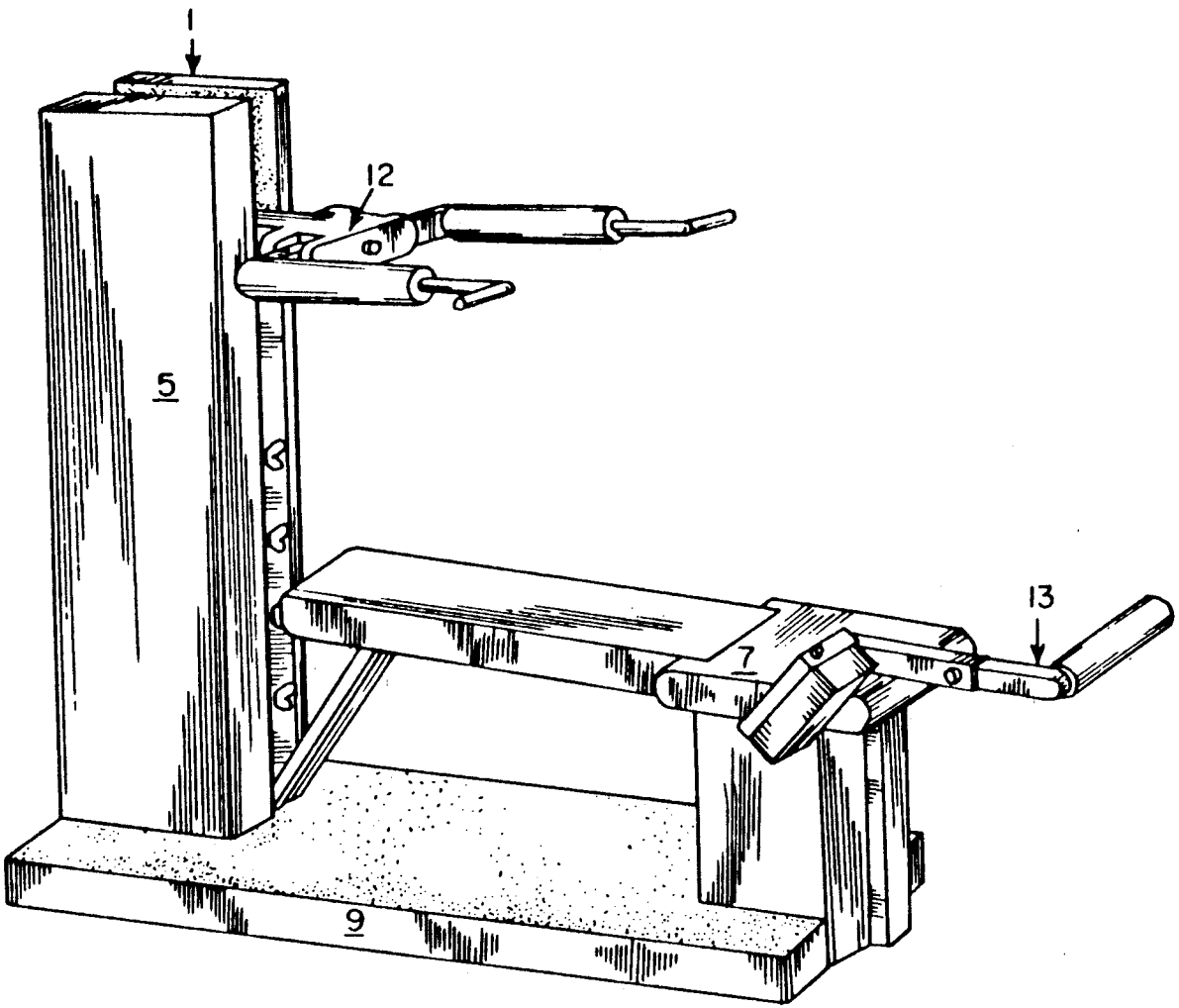
FIG. 1 is a perspective view of the automatic force generating and control system forming the present invention.

Referring now to the drawings wherein like reference numerals correspond to like parts throughout, there is shown in FIG. 1 an automatic force generating and control system generally designated by numeral 1 according to the present invention. During exercise, the arm 12 is pivoted by the user with respect to the monolith 5 and the lower body exerciser arm 13 is pivoted with respect to the seat 7. Both the monolith 5 and seat 7 are connected to the base 9. The present invention is directed to the hydraulic pressure system 10. Details regarding the electronic controls, mechanical aspects and design of the invention are set forth in applicants' co-pending U.S. patent application Ser. No. 07/435,627, entitled "Automatic Force Generating and Control System", filed on Nov. 13, 1989, U.S. patent application Ser. No. 07/436,191, entitled "Automatic Force Generating and Control System", filed on Nov. 13. 1989, and U.S. Design patent application entitled "Automatic Force Generating and Control System", U.S. patent application Ser. No. 07/434,831, and filed on Nov. 13, 1989, respectively, which are incorporated herein by reference. To the extent necessary, those incorporated applications will be referred to in the context of the ensuing description.

Figure 2:
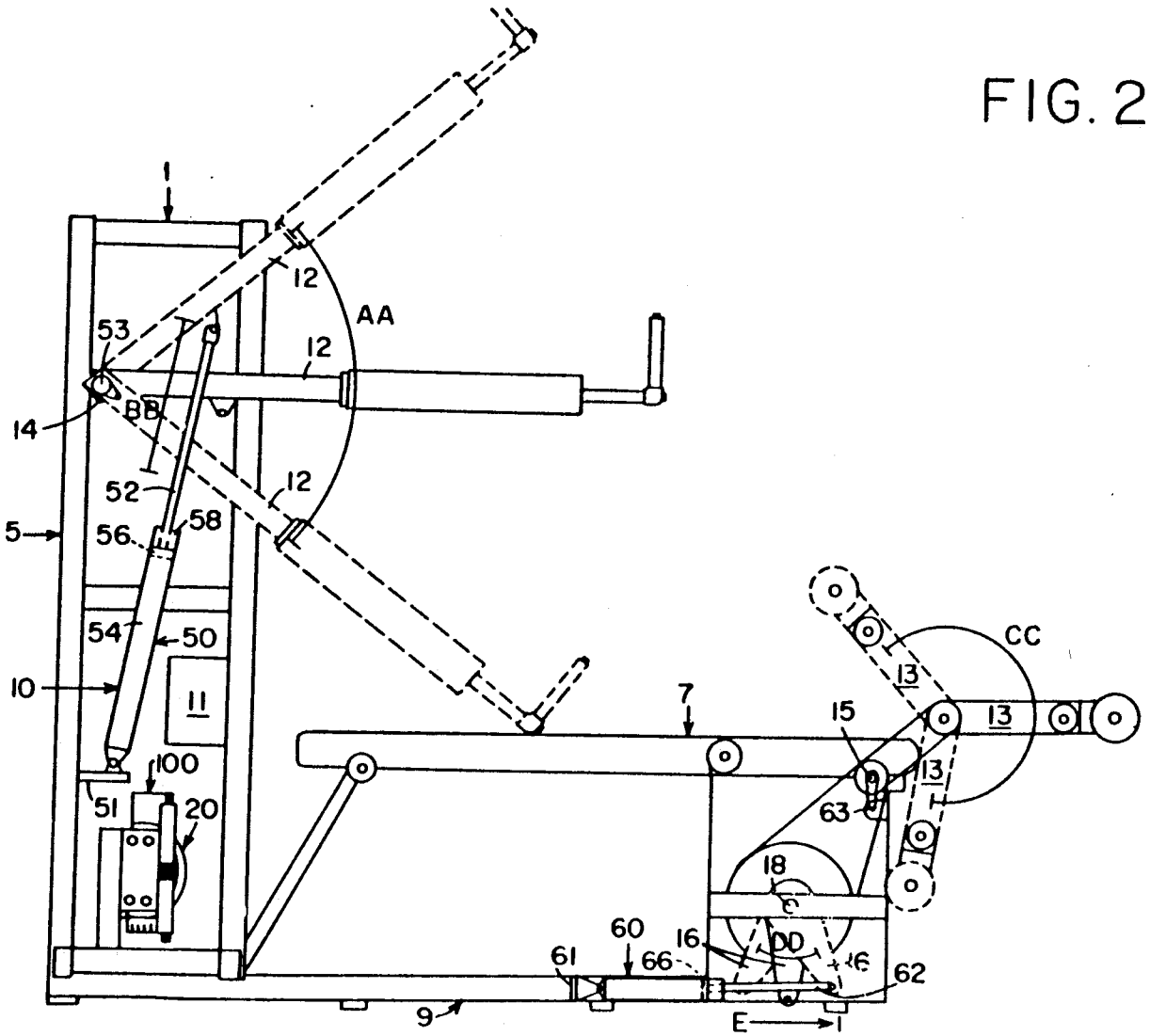
FIG. 2 is a right side view of the system of FIG. 1 with the outer covering partially removed.

FIG. 2 shows the right hand side of the automatic force generating and control system with the outer covering of the monolith 5, the seat 7 and the base 9 removed to show the general arrangement of the hydraulic resistance system 10.

The arm 12 pivots around lever arm pivot 14 in approximately 80° of arc. This arc is shown as arc AA. The arm hydraulics 50 comprising the rod 52, the cylinder 54, the piston 56 (shown in phantom), and the rod end 58 is mounted to the monolith 5 on load cell 51. The load cell 51 is a cantilever beam which contains two strain gauges. One gauge is positioned upon the upper surface of the beam and the other is positioned upon the lower surface of the beam. Thus, as the beam is deflected, one gauge is in tension while the other is in compression. The signals from the gauges of the load cell 51 are sent to the electronic controls 11. Thus, the electronic controls 11 are capable of determining the amount and direction of force being felt through the arm hydraulics 50.

The rod 52 of the arm hydraulics 50 is connected to the arm 12. Thus as the arm 12 goes through its arc AA, the rod 52 is moved linearly through the arm hydraulics 50. The piston 56 is similarly moved linearly through the arm hydraulics 50. The total length of linear movement is shown as length BB in FIG. 2. Thus, for any given position of the arm 12 in the stroke AA there is a corresponding position of the piston 56 in the linear length BB. The arm potentiometer 53 is mounted upon the pivot 14 and is capable of determining the position of the arm 12 within the stroke AA. This signal is sent to the electronic controls 11.

Thus, the electronic controls 11 receives information concerning the amount and direction of force being felt in the arm hydraulics 50, the location of the arm 12 in its stroke AA and by processing the information may determine the direction and speed of movement of the arm 12 in its stroke AA. This information is used as feed back by the electronic controls 11 to determine the location and amount of pressurized flow to supply the system 10.

The leg hydraulic 60 are also shown in FIG. 2. The leg hydraulic 60 comprise the rod 62, the cylinder 64, the piston 66 (shown in phantom), and the rod end 68 of the leg hydraulics 60. The leg hydraulics 60 are mounted to the system 1 by leg load cell 61. Similar in construction to the arm load cell 51, the leg load cell 61 comprises a cantilever beam with two strain gauges. Thus, as the leg hydraulics 60 experience force, either compression or tension, the load cell 61 is capable of determining the direction and magnitude of that force and sending electronic information to the electronic controls 11 concerning the amount and direction of the force.

The lower body exerciser arm 13 is also shown in FIG. 2. This arm 13 pivots while the user is exercising. The total arc of pivot is approximately 240° as shown as arc CC in FIG. 2. The arc CC is geared down to arc DD of crank arm 16. The gearing down is approximately four to one so the arc DD is approximately 60°. The crank arm 16 pivots around crank arm pivot 18. Crank arm 16 is connected to rod 62 of the leg hydraulics 60. Thus, the arc movement DD is translated into linear movement of the rod 62 within the arm hydraulic 60. This linear movement is shown as length EE in FIG. 2. Thus, for any given position for lower body exerciser leg 13 within its strokes CC there is a corresponding position for crank arm 16 within its arc DD and a corresponding position of rod 62 and piston 66 within the leg hydraulics 60.

Leg potentiometer 63 is mounted upon the rotating shaft 15 which is rotatably connected to the arm 13. Thus, the potentiometer 63 is also capable of determining the position of the arm 13 within its stroke CC. The potentiometer 63 sends this information electronically to the electronic controls 11. By processing this information the electronic controls 11 is capable of determining the speed and direction of the rotation of the arm 13.

Thus, the electronic controls 11 are capable of determining the direction of the force and the amount of the force being exerted by the arm 12 upon the arm hydraulics 50 by load cell 51. The electronic controls are also capable of determining the position, speed and direction of rotation of the arm 12 within its stroke AA by the potentiometer 53. The electronic controls 11 are also capable of determining the amount and direction of force being exerted by the user upon the lower body exerciser arm 13 and the direction of the force upon the leg hydraulics 60 by the load cell 61. The electronic controls are also capable of determining the position, speed and direction of rotation of the arm 13 within its stroke CC by the potentiometer 63.

FIG. 2 also shows the pump assembly 20 which comprises the pump 22 and the motor 24. In addition, the manifold assembly 100 which contains the hydraulic circuitry as discussed below is also shown in FIG. 2. The hydraulic circuitry 100 is connected to the electronic controls 11 to direct the flow from the pump assembly 20 to the respective hydraulics 50 and 60 at the pressure and flow required for the particular exercise as described below.

Figure 3:
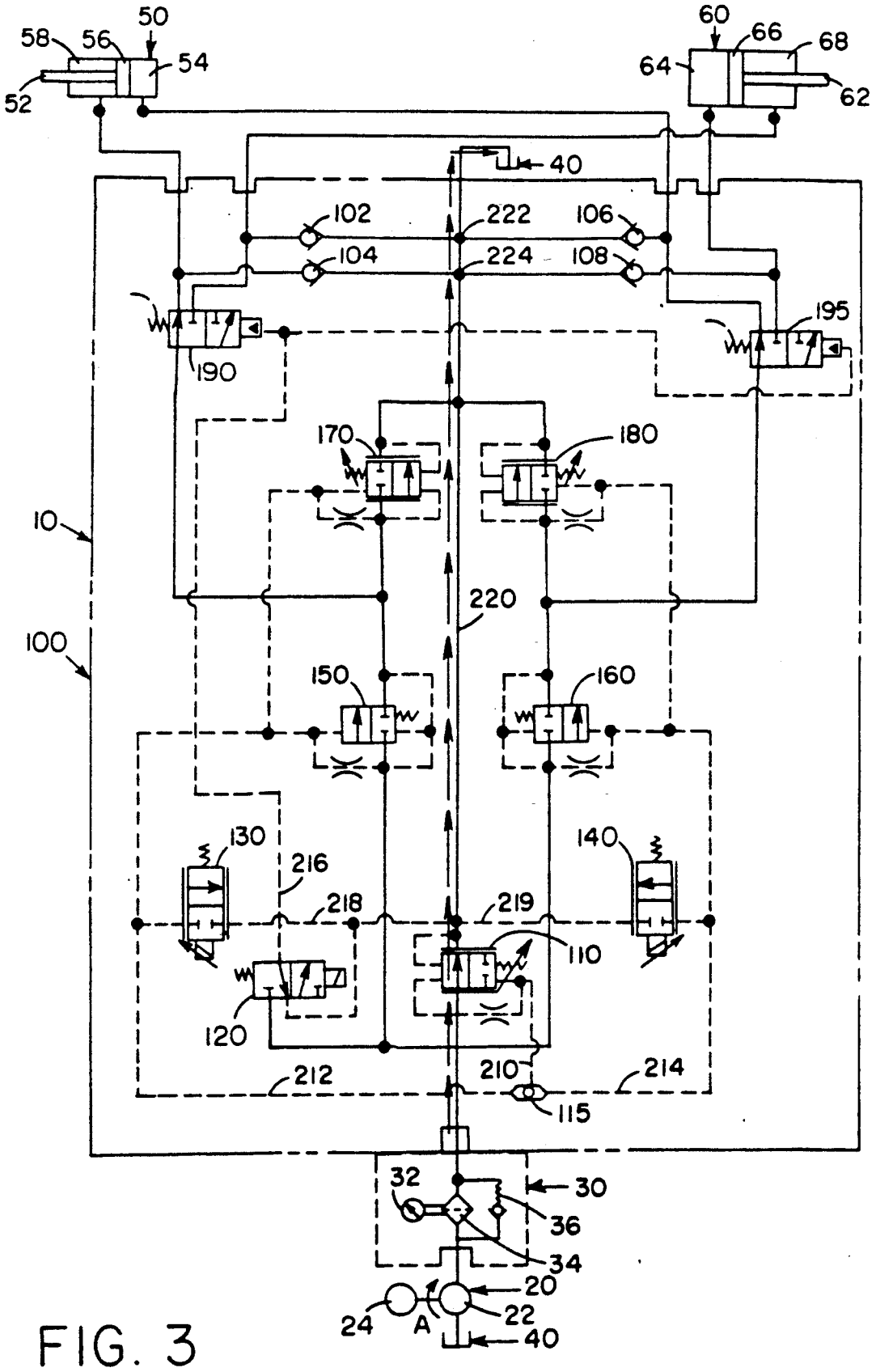
FIG. 3 is a schematic view of the hydraulic system of FIG. 1 idling.

FIG. 3 shows a hydraulic resistance system, generally designated by numeral 10 according to the present invention. The system 10 is generally comprised of the pump assembly 20, the filter subassembly 30, the reservoir 40, the arm cylinder 50, the leg cylinder 60, and the manifold assembly 100. The manifold assembly 100 is generally comprised of the first check valve 102, the second check valve 104, the third check valve 106, the fourth check valve 108, the first vented pilot operated relief valve 110, the shuttle valve 115, the 3-way 2-positioned solenoid valve 120, the first proportional pressure relieving valve 130, the second proportional pressure relieving valve 140, the first normally closed switching element 150, the second normally closed switching element 160, the second vented pilot operated relief valve 170, the third vented pilot operated relief valve 180, the first 3-way directional, pilot operated, spring return control valve 190 and the second 3-way directional, pilot operated, spring return control valve 195.

FIG. 3 shows the system 10 at rest. Fluid is drawn from the reservoir 40 by the motor 24 and the pump 22. The pump 22 is rotating in the direction A. The fluid is passed through the filter subassembly 30 which comprises a filter 34, a bypass element including a spring loaded check valve 36 and an indicator 32. The filter subassembly 30 performs the function of cleaning the fluid. The preferred fluid is CASTROL 10W40. At this point the fluid enters the manifold 100 and passes through the first vented pilot operated relief valve 110. The first vented valve 110 is open because there is no pilot flow in pilot line 210. There is no pilot flow in line 210 because neither of the proportional valves 130 and 140 are energized. The shuttle valve 115 is in its neutral position because there is no pilot flow. The fluid flows through the main gallery 220 and back to the reservoir 40. Thus the system 10 in FIG. 3 is idling.

Figure 4:
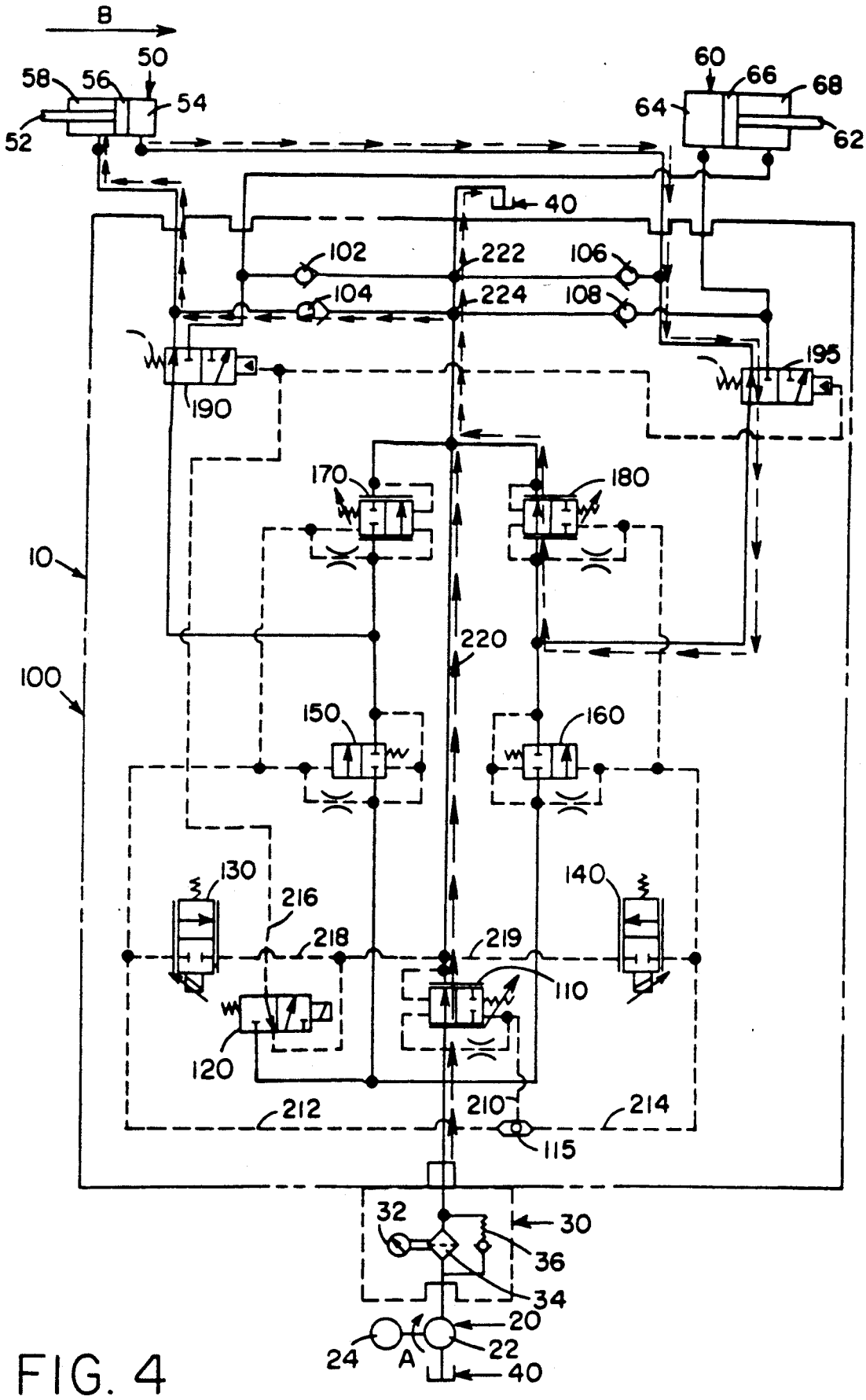
FIG. 4 is a schematic of the hydraulic system of FIG. 1 with the user positioning the piston within the arm hydraulics in one direction while encountering little resistance.
Figure 5:
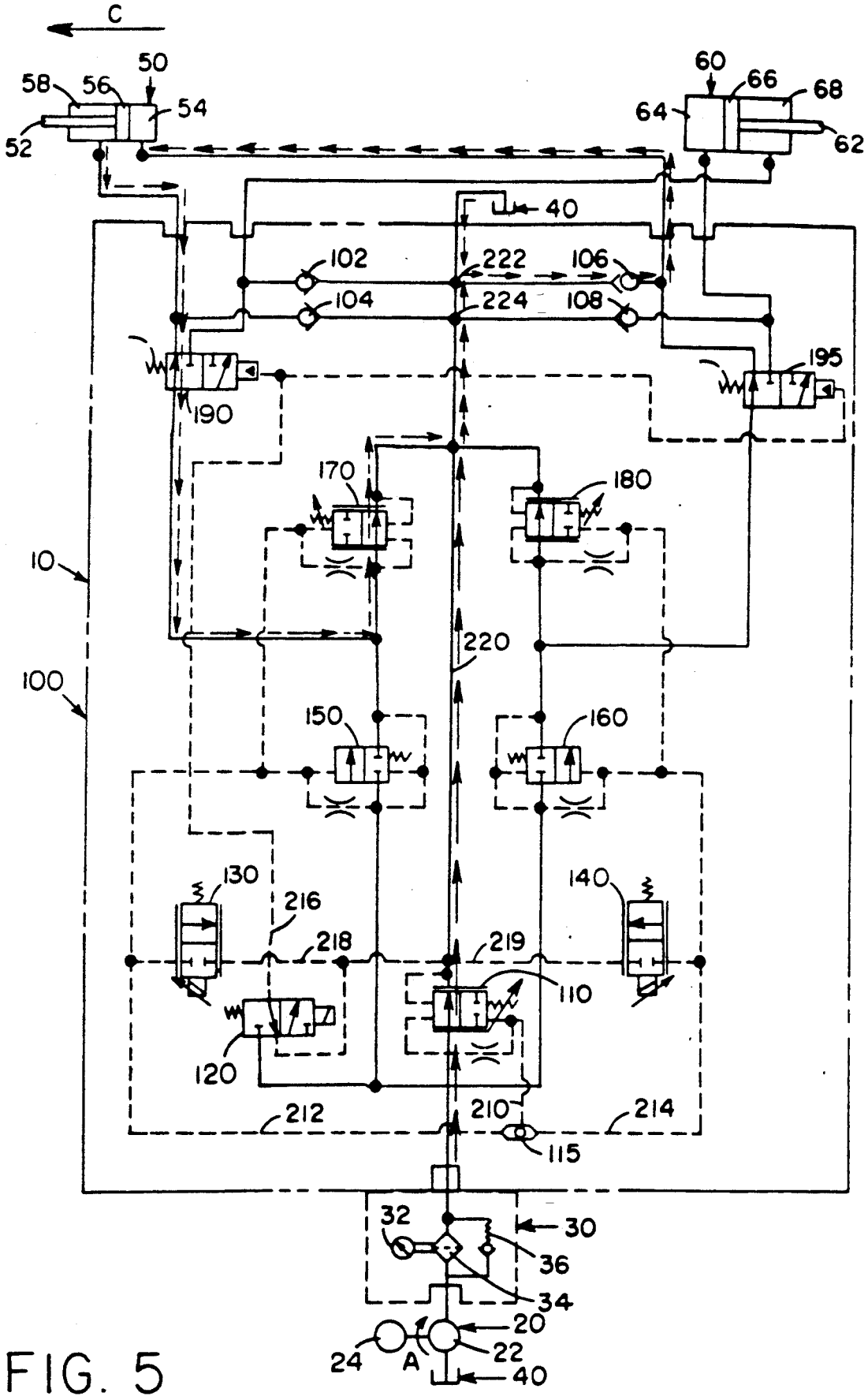
FIG. 5 is a schematic of the hydraulic system of FIG. 1 with the user positioning the piston within the arm hydraulics while encountering little resistance in the opposite direction of FIG. 4.

FIGS. 4 and 5 show how the user may position the piston 56 (and thereby the arm 12) within the hydraulics 50 to the desired start position while encountering little resistance to motion from the system 10. Thus the user may position the arm 12 to the location within its stroke AA which is most comfortable for the user before initiating resistance to movement by the system 10. FIG. 4 shows how the piston 56 may be moved in the direction B and FIG. 5 shows how the piston 56 may be moved in the direction C.

FIG. 4 shows the hydraulic resistance system 10 at rest and the user positioning the piston 56 to the desired starting position within the arm hydraulics 50. Specifically, the user in FIG. 2 is moving the piston 56 from the left to the right by moving the rod 52 of the hydraulics 50 to the right as shown by direction arrow B. When the piston head 56 is moved in the direction B, fluid is evacuated from the blind end 54 of the hydraulics 50 through the second control valve 195. These first and second control valves 190 and 195 are shifted open because there is no pilot flow in line 216. There is n pilot flow in line 216 because the solenoid valve 120 is closed. Solenoid 120 determines whether the arm hydraulics 50 or the legs hydraulics 60 is being utilized. At this point the fluid moves through the third vented relief valve 180 which is shifted open by the presence of fluid pressure in the return line or return pressure. The fluid then enters the main gallery 220. Thus fluid is evacuated from the blind end 54 of the arm hydraulics 50.

At the same time fluid enters the rod end 58 of the hydraulics 50 through the second check valve 104 which is unseated by the flow. Because of the presence of the rod 52, the rod end 58 of the hydraulics 50 requires less fluid than the blind end 54 as the piston 56 moves in the direction B. Accordingly some fluid is returned to the reservoir 40. Thus, the rod 52 may move in the direction B with little impedance. This enables the user to move the piston 56 (and thereby the arm 12) to the desired start position in the direction B with little resistance from the system 10.

FIG. 5 shows the system 10 at rest with the user moving the rod 52 of the arm hydraulics 50 in the direction C. The user is encountering little resistance from the system 10. This demonstrates the ability to move the rod 52 (and thereby the ar 12) within the arm hydraulics 50 to the desired starting position for a given exercise.

As shown in FIG. 5, fluid from the rod end 58 of the arm hydraulics 50 is forced out of the arm hydraulics 50 and passes through the first 3-way directional control valve 190. The first control valve 190 is shifted open because there is no pilot flow in line 216 because the solenoid valve 120 is closed. The fluid then passes through the first vented pilot operated relief valve 170 which is shifted open by the return pressure. At this point the fluid enters the main gallery 220 and flows past the third check valve 106 which is unseated by the flow. The fluid then leaves the manifold assembly 100 and reenters the blind end 54 of the arm hydraulics 50. Because the rod 52 takes up space in the rod end 58, additional fluid is required to fill the blind end 54 when the piston head 56 is moved in the direction C. This fluid is taken from the reservoir 40 and joins the fluid previously described at junction point 222. Thus the user may position the piston 56 at the desired position within the arm hydraulics 50 in either the direction B (as shown in FIG. 4) or in the direction C (as shown in FIG. 5) with little resistance.

At this point the user has positioned the piston 56 (and thereby the arm 12) in the location most comfortable to him/her without encountering substantial resistance from the system 10 by moving the piston 56 in the direction B (FIG. 2) and/or direction C (FIG. 3). Now the user wishes to exercise by moving the piston 56 against a desired force provided by the system 10. The exercise is produced by moving the piston 56 against pressure.

Figure 6:
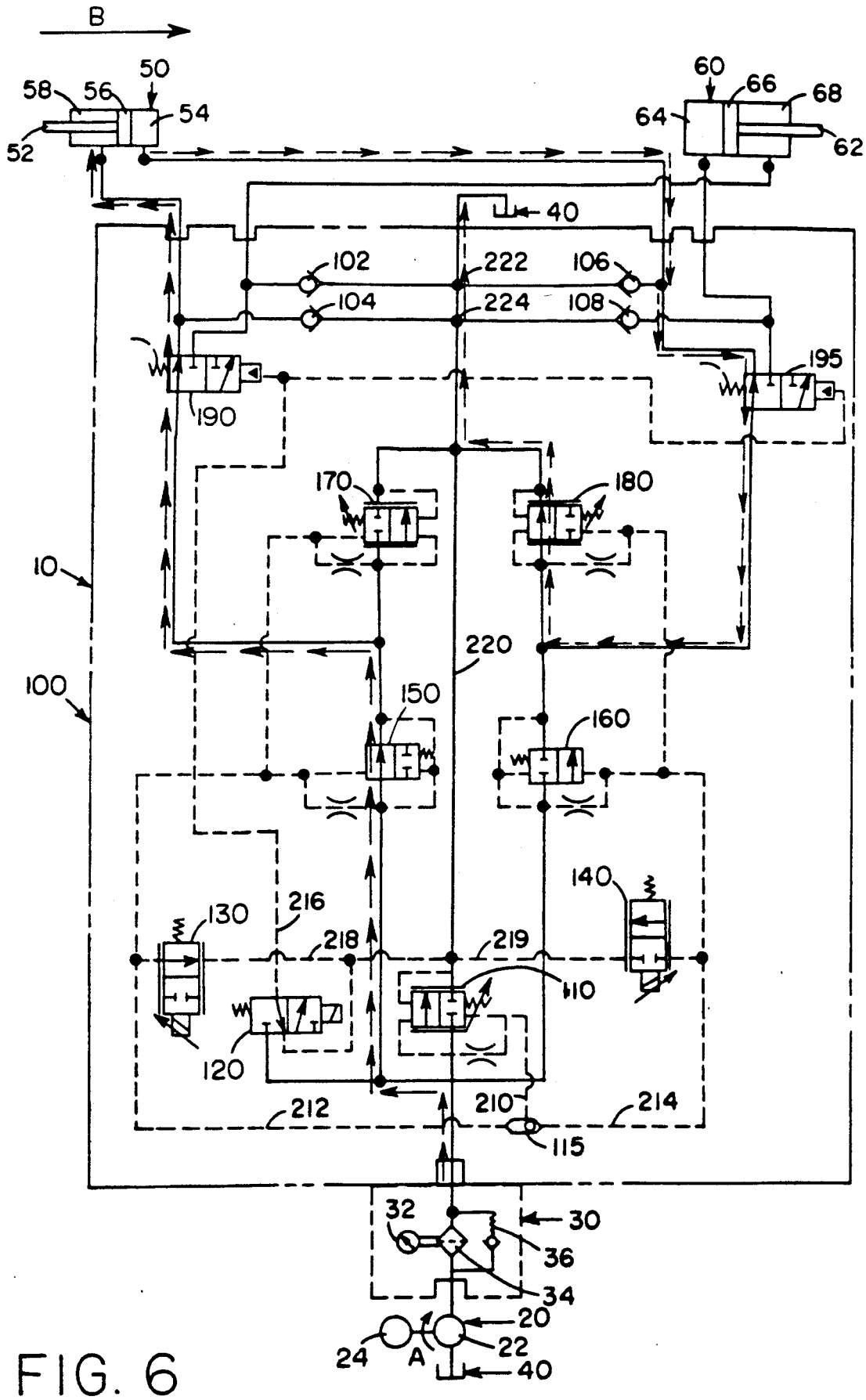
FIG. 6 is a schematic view of the hydraulic system of FIG. 1 with the system supplying pressurized flow to the rod end of the arm hydraulics.

FIG. 6 shows the system 10 energized so as to exert a force upon the piston head 56 to move the piston 56 in the direction B. Thus, the rod 52 is being forced in the direction B by the system 10 and the user may exercise against the rod 52 by working against the pressure exerted upon the piston head 56.

As shown in FIG. 6 the system 10 is energized through the first proportional pressure relieving valve 130. The valve 130 is proportionally controlled in its range of operation dependent upon the percent or amount of current excitation received from the electronic controls 11. If there is no electrical impulse the valve 130 is at rest and closed (see FIGS. 3 to 5). However, when the user desires the system 10 to be energized as shown in FIG. 6, the valve 130 is partially or fully opened by an increment of current. The amount of excitation is determined by the electronic controls 11 and by setting the amount of excitation or current into the valve 130 the controls 11 set the amount of pressure exerted by the system 10 upon the piston 56.

FIG. 6 shows the system 10 energized to exert a pressure on the piston 56 in the direction B. The electronic controls 11 partially opens the proportional valve 130 which shifts the first vented valve 110 closed because of the pressure in pilot flow line 218. The pilot line 212 is pressurized after the valve 110 shuts via the line 218. Flow then biases the shuttle 115 to the right and continues through the line 210 and goes to the switching element 150 and the valve 170. Absence of pressure in line 214 allows the shuttle 115 to remain to the right.

The spool in the valve 110 is closed by the line 218 an the pressure required to open the spool in the value 110 backup is determined by the amount of pressure biased against the spring by the line 210. The proportional valve 130 sends a pilot signal to both ends of the valve 110. The strength of the signal in pounds-per-square inch through the pilot line 210 sets the valve 110. Thus the force coil in the proportional valve 130 becomes the primary generator of force and the force generated through the valve 110 is directly proportional to the spring bias affected by the coil setting of the value 130.

The pressurized flow from the pump assembly 20 is diverted around the first vented valve 110 and flows through the first switching element 150 and the first three-way control valve 190 and into the rod end 58 of the arm hydraulics 50. Simultaneously, fluid is expelled from the blind end 54 of the arm hydraulics 50, through the second three-way control valve 195, through the third relief valve 180 and back to the reservoir 40 via the main gallery 220.

The current input to the force coil in the proportional valve 130 is set by the electronic controls 11. In response to the current excitation the force current moves the spool of the proportional valve 130 to a tension commensurate with the amount of current excitation. The pilot signal from proportional valve 130 also sets the spring pressure in the valves 110 and 170. It is this spring pressure which the user must overcome.

Figure 7:
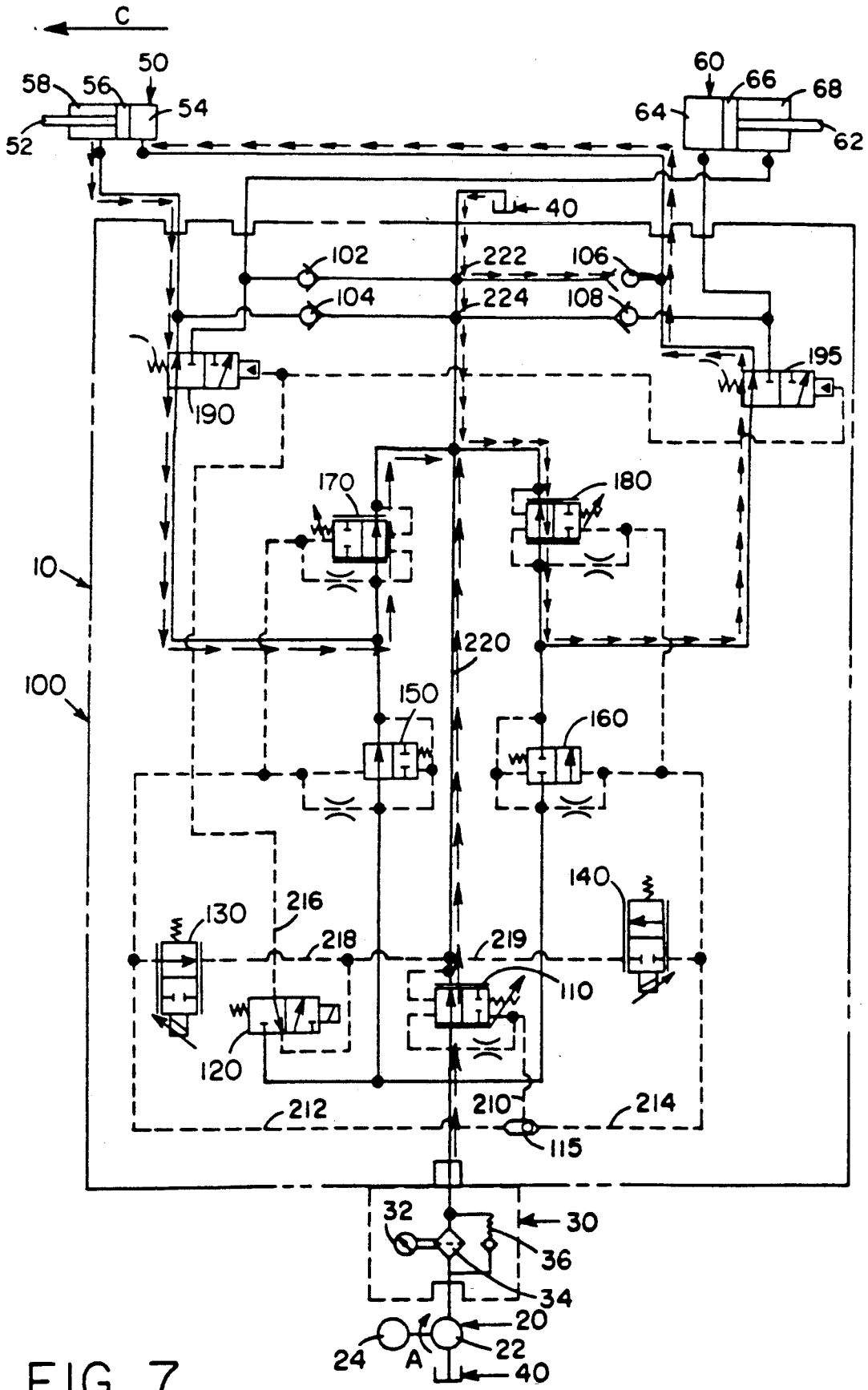
FIG. 7 is a schematic view of the hydraulic system of FIG. 1 where the user has successfully overcome the pressurized flow of FIG. 6.

FIG. 7 shows the system 10 with the user successfully working against the pressure in the rod end 58 of the arm hydraulics 50 generated by the system 10 as shown in FIG. 6. The user in FIG. 7 is moving the piston 56 in the direction C against the pressure generated by the system 10.

In FIG. 7 the user has successfully generated pressure sufficient to overcome the pressurized flow into the rod end 58. At this time fluid flows out of the end 58 through the first three-way control valve 190. This back pressure opens the first and second vented valves 110 and 170, because the back pressure generated by the user is greater than the pressure generated by the proportional valve 130 which had previously closed valves 110 and 170 (FIG. 6).

Fluid flows into the blind end 54 from the main gallery 220 through the third relief valve 180 and second three-way control valve 195. Because the blind end 54 requires more fluid than the fluid being evacuated from rod end 52 make-up fluid is drawn from the reservoir 40 and passes through third check valve 106 which is unseated by the flow.

Pressure flow is being exerted from the pump through the first relief valve 110 which is shifted open by return pressure and into the main gallery 220. So long as the user successfully works against the force exerted by the system 10, the valves 170 and 110 will remain open and fluid will be evacuated from the rod end 58. Should the user fail to move the rod 52 and the piston 56, back pressure will no longer exist and the valves 110 and 170 will shut due to the pilot flow from the proportional valve 130 thereby directing fluid pressurized by the pump 22 into the blind end 54 and moving the piston 56 in the direction B as shown in FIG. 6.

Figure 8:
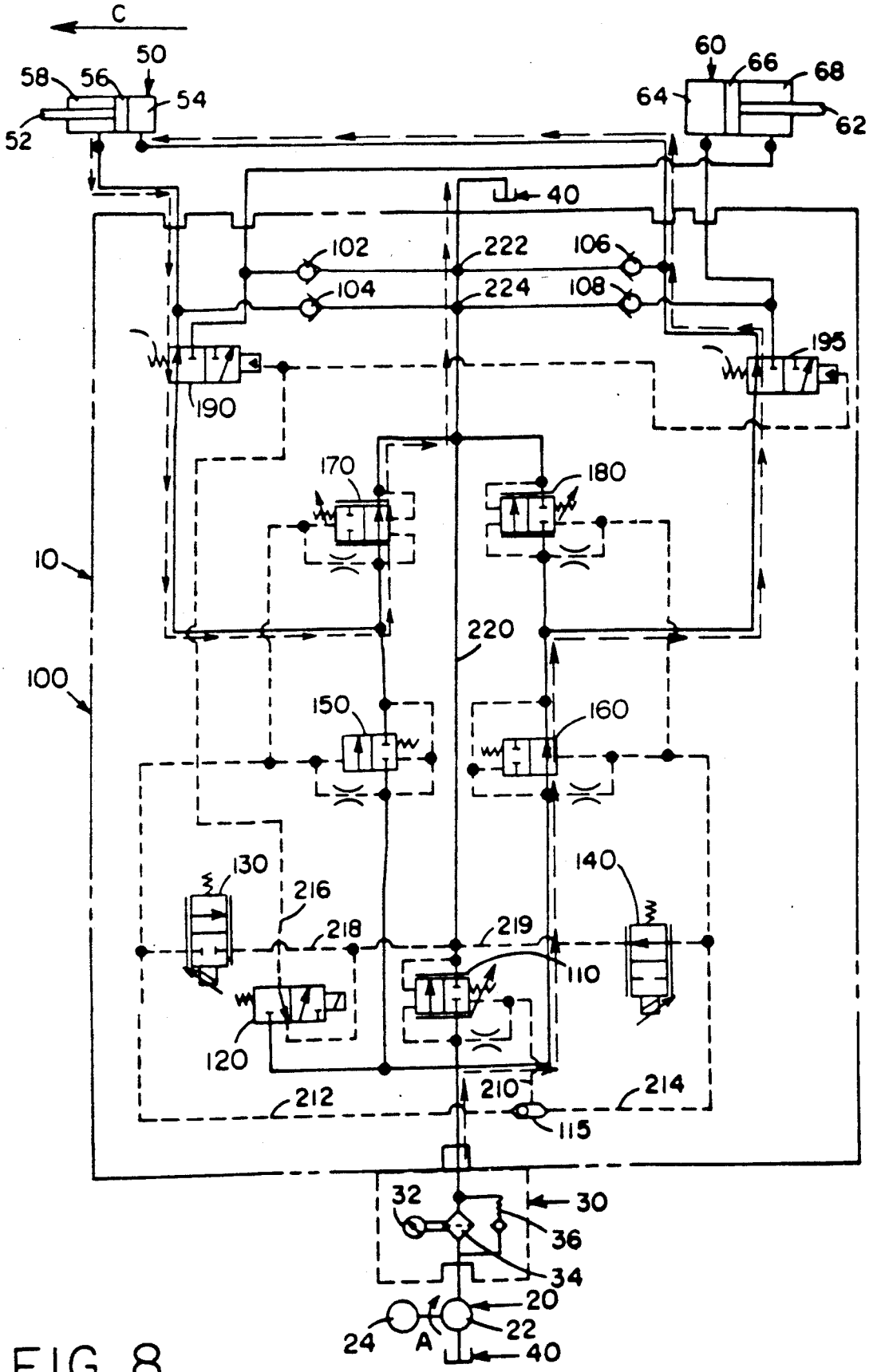
FIG. 8 is a schematic view of the hydraulic system of FIG. 1 with the system supplying pressurized flow to the blind end of the arm hydraulics.

FIG. 8 shows the system 10 energized so as to exert a pressure upon the piston head 56 to move the piston head 56 in direction C as shown in FIG. 8. Thus, the rod 52 is being forced in the direction C by the system 10 and the user ma exercise against the rod 52 by counteracting the force exerted upon the rod 52.

As shown in FIG. 8 the system 10 is energized through the second proportional pressure relieving valve 140. As with the valve 130, the valve 140 is proportionally controlled in its range of operation dependent upon the percent or amount of current excitation received from the electronic controls 11. If there is no electrical impulse, the valve 140 is at rest and closed (see FIGS. 3 through 7). However, when the user desires the system 10 to be energized as shown in FIG. 8, the valve 140 is partially or fully opened by an increment of current. The amount of excitation from the electronic controls 11 is selected by the user and by selecting the amount of excitation or current into the valve 140 the user selects the amount of pressure exerted by the system 10 upon the piston 56.

FIG. 8 shows the system 10 energized to exert a pressure on the piston 56 in the direction C. The electronic controls 11 partially opens the proportional valve 140 which shifts the first vented valve 110 closed because of the return pressure in pilot flow line 219. The pilot line 214 is pressurized after the valve 110 shuts via the line 219. Flow then biases the shuttle 115 to the left and continues through the line 210 and goes to the switching element 160 and the valve 180. Absence of pressure in line 212 allows the shuttle 115 to remain to the left.

The spool in the valve 110 is closed by the line 219, and the pressure required to open the spool in the valve 110 back up is determined by the amount of pressure biased against the spring by the line 210. The proportional valve 140 sends a pilot signal to both ends of the valve 110. The strength of the signal in pounds-per-square inch value through the pilot line 210 sets the valve 110. Thus the force coil in the proportional valve 140 becomes the primary generator of force and the force generated through the valve 110 is directly proportional to the spring bias affected by the coil setting of the valve 140.

The pressurized flow from the pump assembly 20 is diverted around the first vented valve 110 and flows through the second switching element 150. The pressurized fluid then flows through the second three-way control valve 195 and into the blind end 54 of the arm hydraulics 50. Simultaneously, fluid is expelled from the rod end 58 of the arm hydraulics 50, through the first three-way control valve 190, through the second relief valve 170 and back to the reservoir 40 via the main gallery 220.

Similar to the proportional valve 130 as described above, the current input to the force coil in the proportional valve 140 is set by the electronic controls 11. In response to the current excitation the force current moves the spool of the proportional valve 140 to a tension commensurate with the amount of current excitation. The pilot signal from the proportional valve 140 also sets the spring pressure in the valves 110 and 180. It is this spring pressure which the user must overcome.

Figure 9:
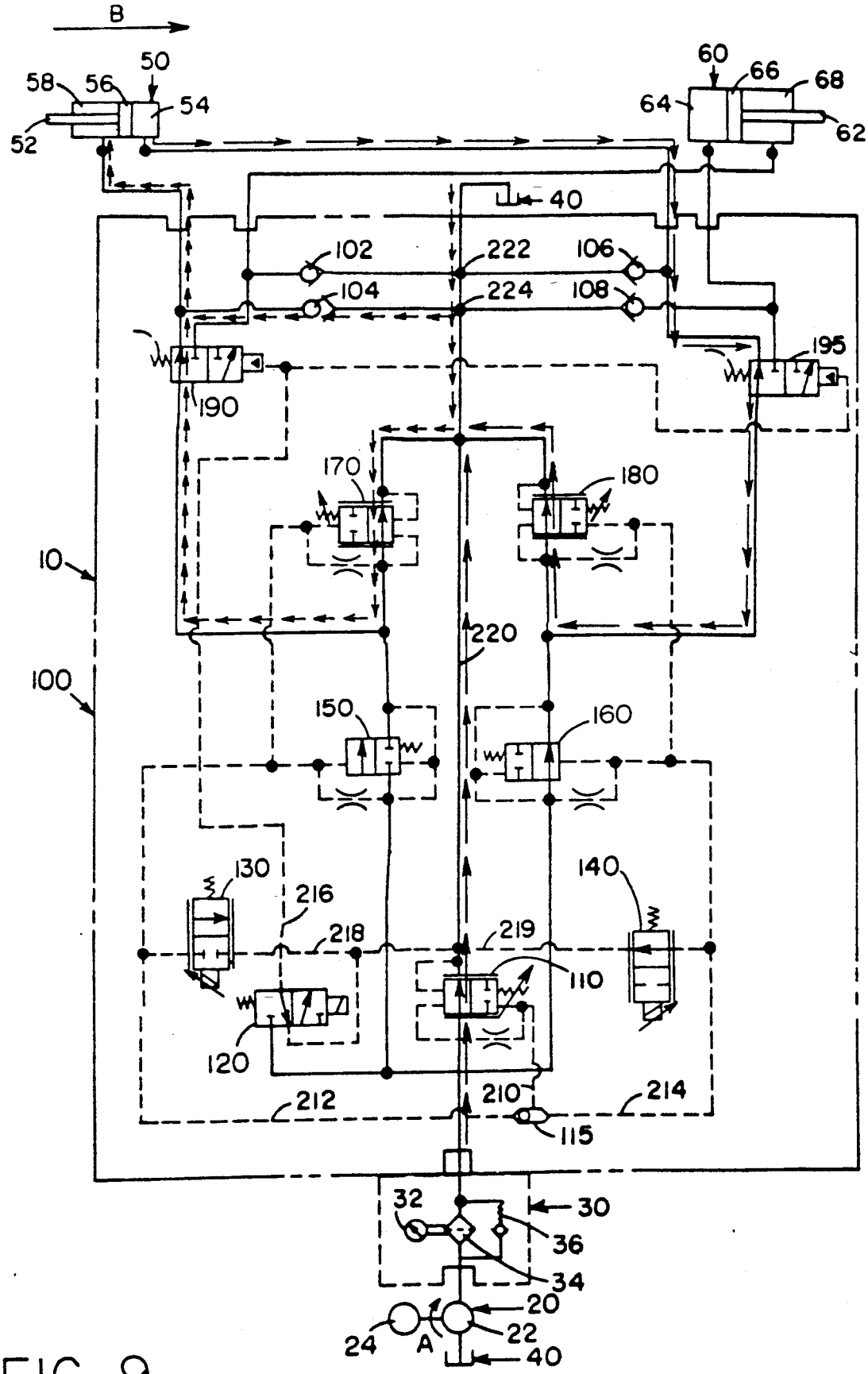
FIG. 9 is a schematic view of the hydraulic system of FIG. 1 with the user successfully overcoming the pressurized flow of FIG. 8.

FIG. 9 shows a system 10 with the user successfully working against the pressure in the blind end 54 of the hydraulics 50 generated by the system 10 as shown in FIG. 8. The user in FIG. 9 is moving the piston 56 in the direction B against the pressure generated by the system 10.

In FIG. 9 the user has successfully generated pressure sufficient to overcome the pressurized flow into the blind end 54. At this time, fluid flows out of the blind end 54 through the second control valve 195. This back pressure opens the first and third vented valves 110 and 180, because the back pressure generated by the user is greater than the pressure generated by the proportional valve 140 which had previously closed valves 110 and 180 (FIG. 8).

Fluid flows into the rod end 58 from the main gallery 220 through the second relief valve 170 and the first control valve 190. Make-up fluid from the reservoir 40 also enters the end 58 via the second check valve 104 which is unseated by the back flow. Pressure flow is being exerted from the pump 22 through the first relief valve 110 which is shifted open by return pressure and into the main gallery 220. So long as the user successfully works against the force exerted by the system 10, the valves 180 and 110 remain open and fluid will be evacuated from the blind end 54. Should the user fail to move the rod 52 and the piston 56, back pressure will no long exist and the valves 110 and 180 will shut thereby directing fluid pressurized by the pump 22 into the end 54 and moving the piston 56 in the direction C as shown in FIG. 8.

Figure 10:
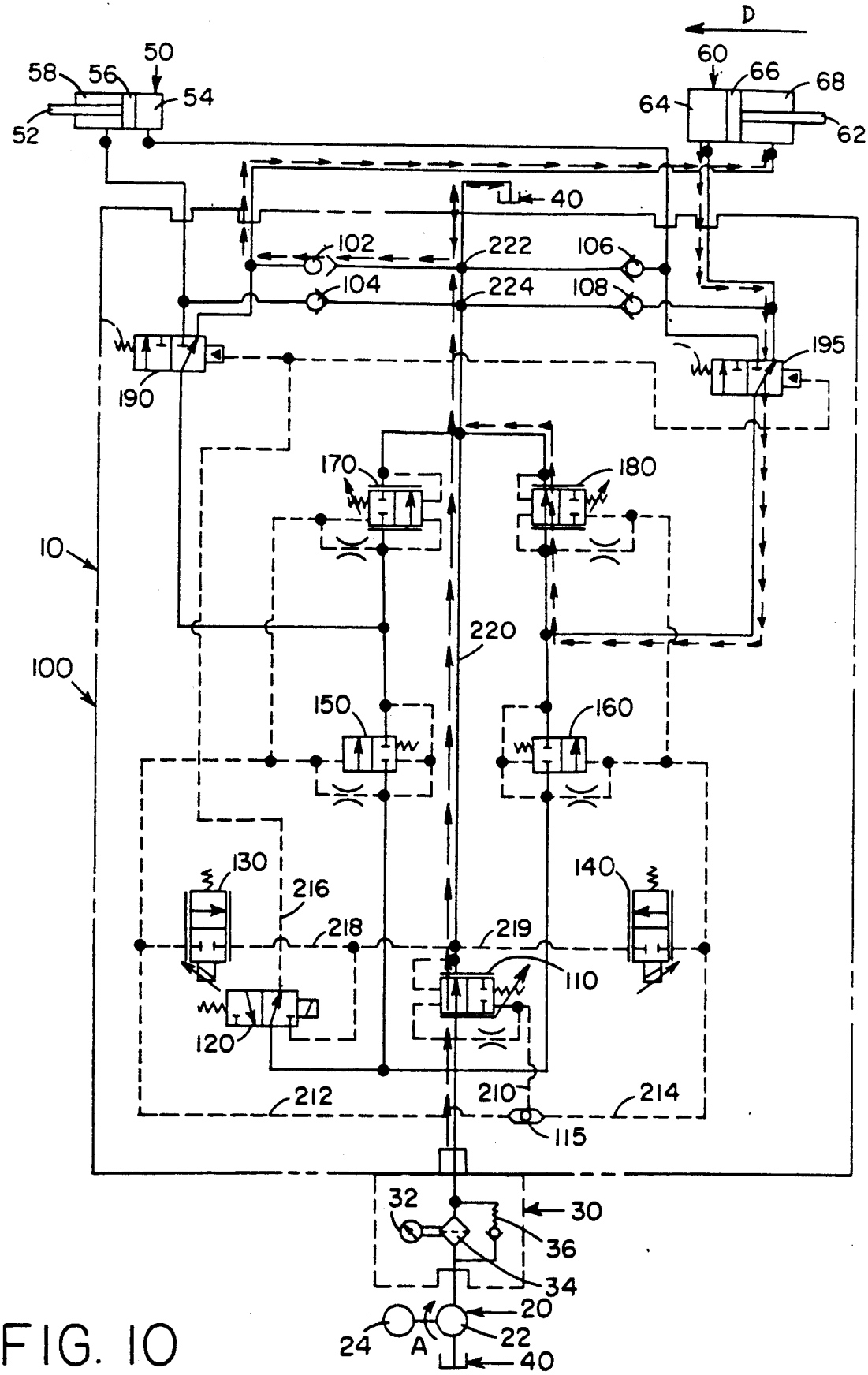
FIG. 10 is a schematic view of the hydraulic system of FIG. 1 with the user moving the piston of the leg hydraulics in a direction while encountering little resistance from the system.
Figure 11:
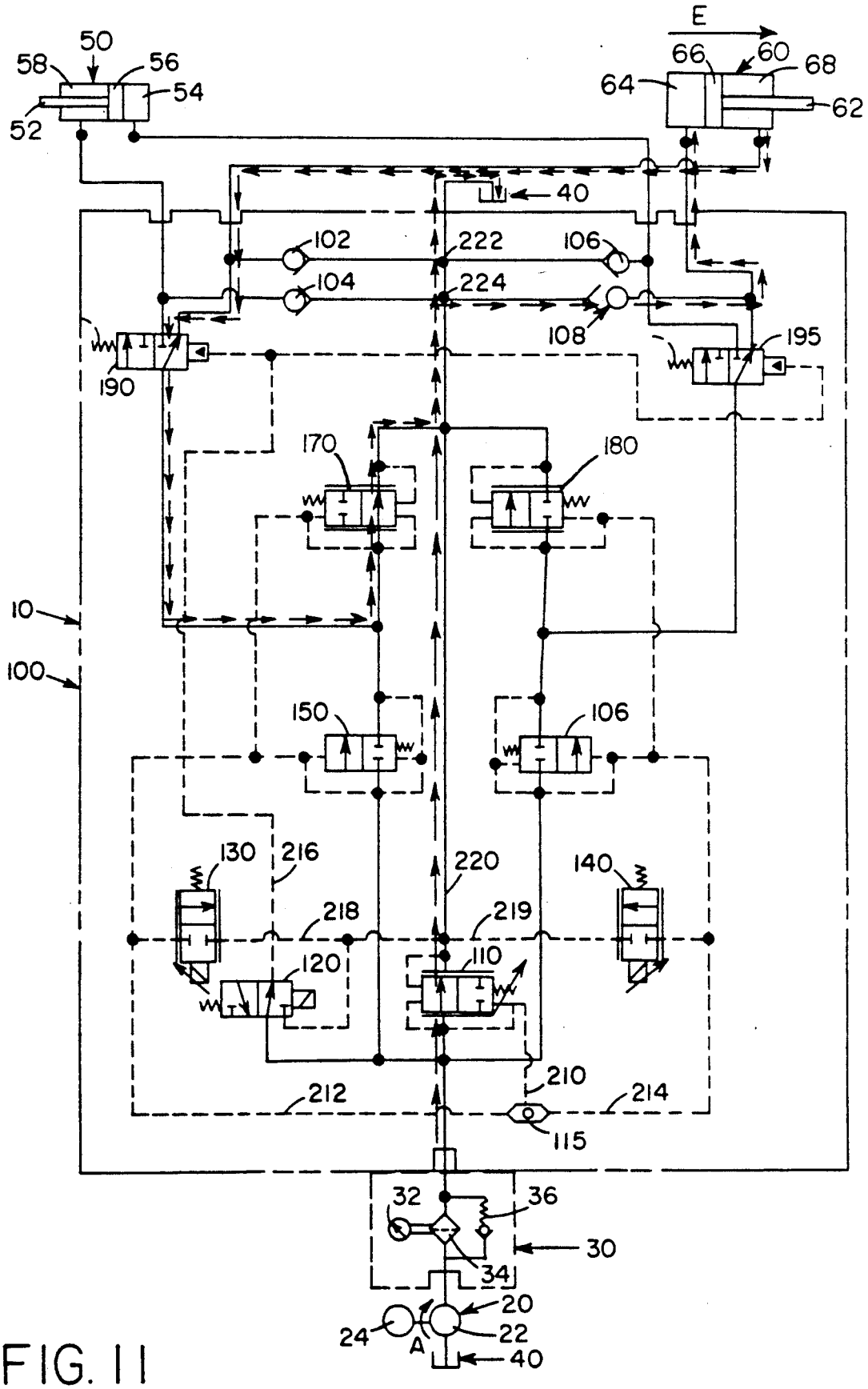
FIG. 11 is a schematic view of the hydraulic system of FIG. 1 with the user moving the piston in the opposite direction of FIG. 10 in the leg hydraulics while encountering little resistance from the system.

FIGS. 10 and 11 show how the user may position the piston 66 (and thereby the lower body exerciser arm 13) within the leg hydraulics 60 to the desired start position while encountering little resistance to motion from the system 10. Thus the user may position the lower body exerciser arm 13 to the location within its stroke CC (FIG. 2) which is most comfortable for the user. FIG. 10 shows how the piston 66 may be moved in the direction D and FIG. 11 shows how the piston 66 may be moved in the direction E.

FIG. 10 shows the hydraulic resistance system 10 at rest and the user positioning the piston 66 to the desired starting position within the arm hydraulics 60. Specifically, the user in FIG. 10 is moving the piston 66 from the right to the left by moving the rod 62 of the hydraulic 60 to the left as shown in direction arm D. When the piston 66 is moved in the direction D, fluid is evacuated from the blind end 64 of the hydraulic 60 through the second control valve 195. These first and second control valves 190 and 195 are shifted from their position in FIGS. 2 through 9 so as to operate the leg hydraulics 60 rather than the arm hydraulics 50 (as shown in FIGS. 2 through 9). The control valves 190 and 195 are shifted to operate the leg hydraulic 60 because there is pilot flow in pilot line 216. The pilot flow in line 216 is caused by the shifting of the solenoid valve 120. This solenoid valve 120 has been shifted by an electronic signal from the electronic controls 11 to operate the leg hydraulics 60 rather than the arm hydraulics 50.

The fluid moves from the second three-way control valve 195 through the third vented relief valve 180 which is shifted open by the presence of fluid pressure in the return line. The fluid then enters the main gallery 220. In this way fluid is evacuated from the blind end 64 of the leg hydraulics 60.

At the same time fluid enters the rod end 68 of the leg hydraulics 60 through the first check valve 102 which is unseated by the flow. Because of the presence of the rod 62, the rod end 68 of the hydraulic 60 requires less fluid than the blind end 64 as the piston 66 moves in the direction D. Accordingly, some fluid is returned to the reservoir 40. Thus, the rod 62 may move in the direction D with little impedance. This enables the user to move the piston 66 (and thereby the lower body exerciser arm 13) to the desired start position in the direction D with little resistance from the system 10.

FIG. 11 shows the system 10 at rest with the user moving the rod 62 of the leg hydraulics 60 in the direction E. The user is encountering little resistance from the system 10. This demonstrates the ability to move the rod 62 (and thereby the lower body exercise arm 13) within the leg hydraulics 60 to the desired starting position for a given exercise.

As shown in FIG. 11, fluid from the rod end 68 of the leg hydraulics 60 is forced out of the leg hydraulics 60 and passes through the first control valve 190. As discussed above, the first three-way control valve 190 is shifted open to the leg hydraulics 60 because there is pilot flow in line 216. The source of the pilot flow is the solenoid valve 120 which is opened by the electronic controls 11. The fluid then passes through the first vented pilot operated relief valve 170 which is shifted open by the return pressure. At this point the fluid enters the main gallery 220 and flows past the fourth check valve 108 which is unseated by the flow. The fluid then leaves the manifold assembly 100 and enters the cylinder end 64 of the leg hydraulic 60. Because the rod 62 takes up space in the rod end 68, additional fluid is required to fill the blind end 64 when the piston head 66 is moved in the direction E. This fluid is taken from the reservoir 40 and joins the fluid previously described at junction point 224. Thus the user may position the piston 66 at the desired position within the leg hydraulic 60 in either the direction D (as shown in FIG. 10) or in the direction E (as shown in FIG. 11) with little resistance.

At this point the user has positioned the piston 66 (and thereby the arm 13) in the location most comfortable to him/her without encountering substantial resistance from the system 10 by moving the piston 66 in the direction D (FIG. 10) and/or direction E (FIG. 11). Now the user wishes to exercise by moving the rod 62 against a desired force provided by the system 10.

Figure 12:
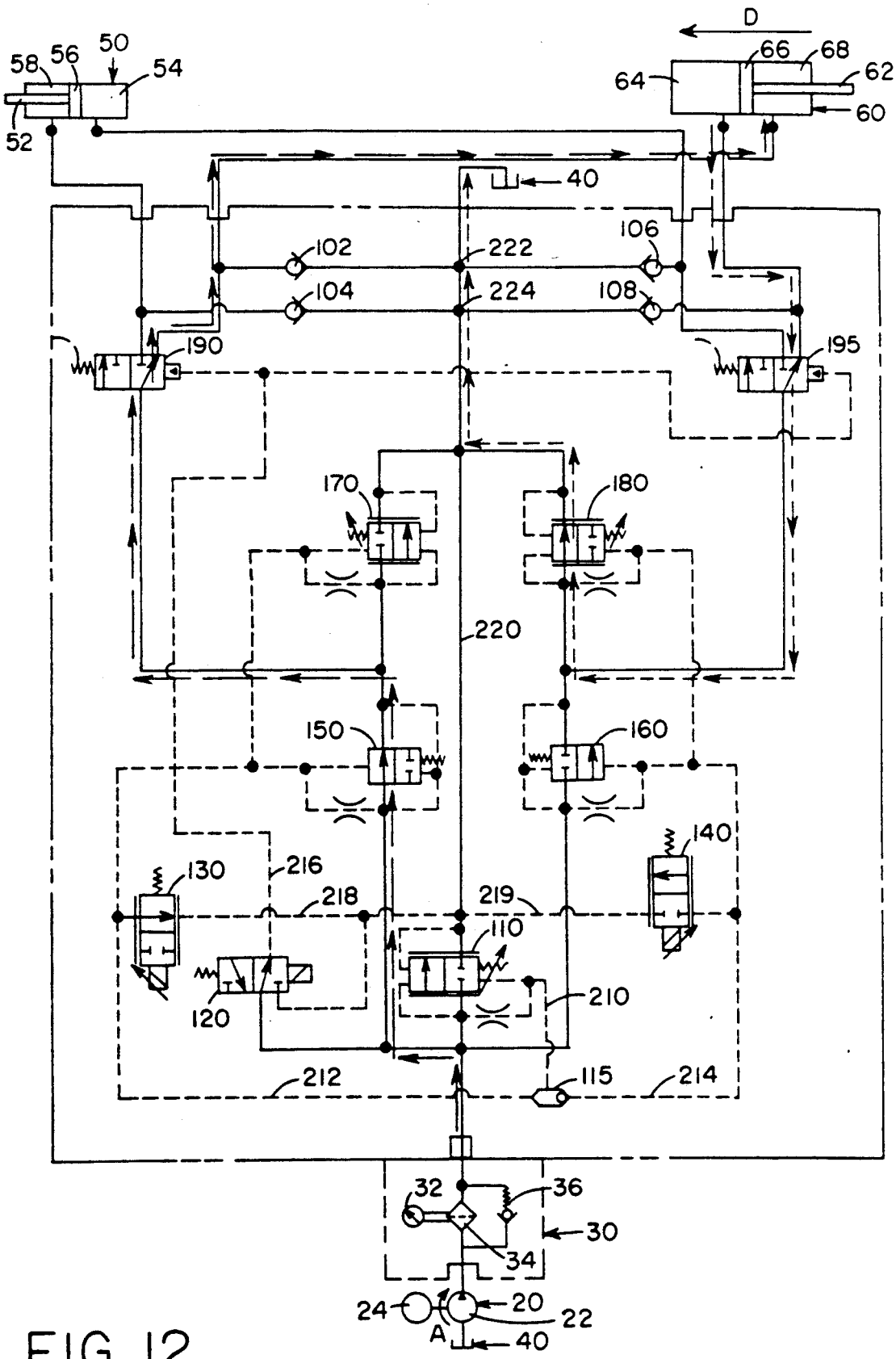
FIG. 12 is a schematic of the hydraulic system of FIG. 1 with the system supplying pressurized flow to the rod end of the leg hydraulics.

As shown in FIG. 12 the system 10 is energized through the first proportional pressure relieving valve 130. The function and operation of the valve 130 was described earlier with regard to FIG. 6.

FIG. 12 shows the system 10 energized so as to exert a pressure upon the piston head 66 to move the piston 66 in the direction D. Thus, the rod 62 is being forced in the direction D by the system 10 and the user may exercise against the rod 62 by working against the pressure exerted upon the piston head 66.

Figure 13:
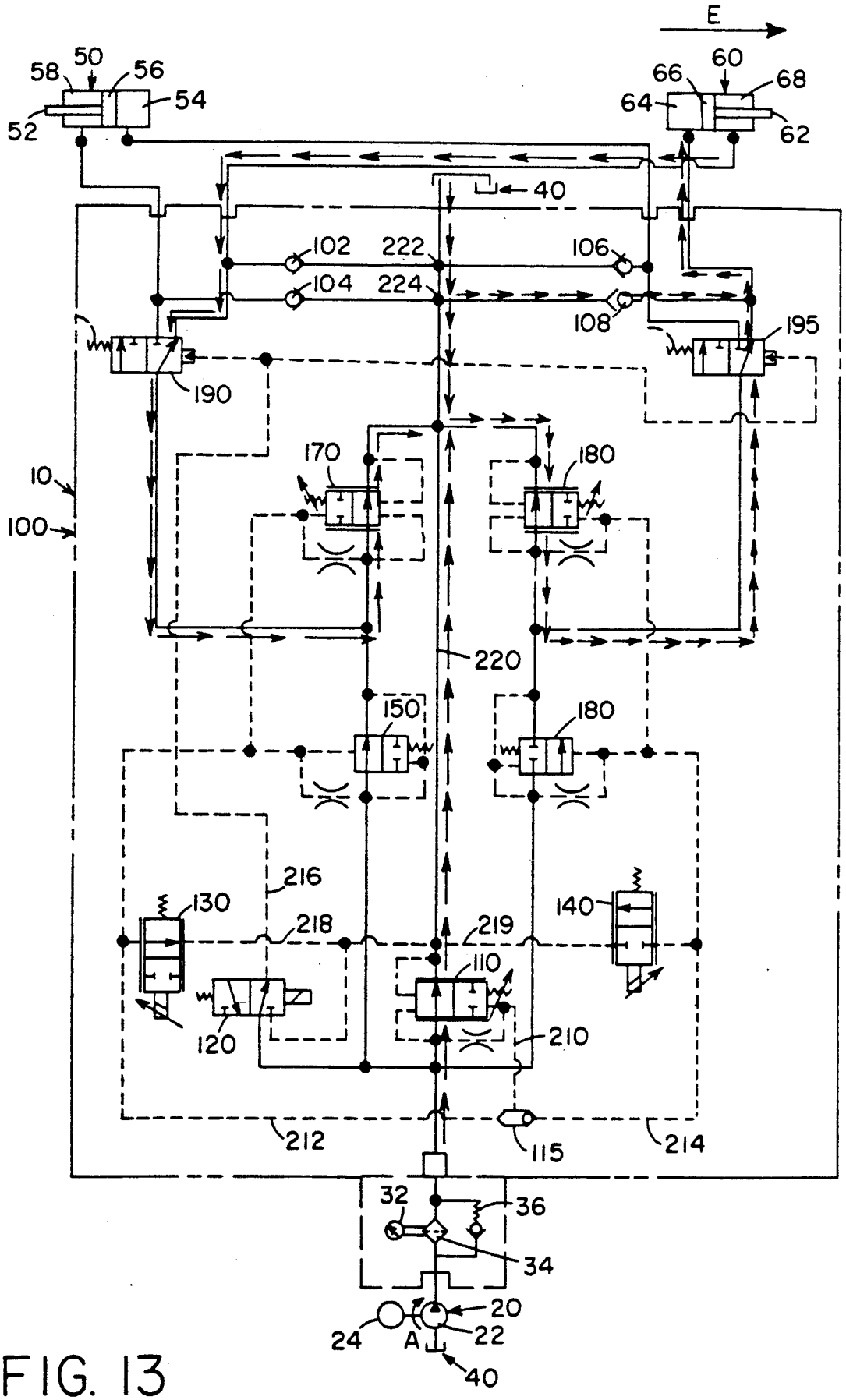
FIG. 13 is a schematic view of the hydraulic system of FIG. 1 with the user successfully overcoming the pressurized flow of FIG. 12.

FIG. 13 shows the system 10 with the user successfully working against the pressure in the rod end 68 of the hydraulic 60 generated by the system 10 as shown in FIG. 12. The user in FIG. 13 is moving the piston 66 in the direction E against the pressure generated by the system 10.

The function and operation of the system 10 in this mode is very similar to that as described below with regard to FIG. 7. Specifically, in FIG. 13 the user has generated a force sufficient to overcome the pressurized flow into the rod end 68. At this time, fluid flows out of rod end 68 through the first three-way control valve 190. This back pressure opens the first and second vented valves 110 and 170, because the back pressure generated by the user is greater than the pressure generated by the proportional valve 130 which had previously closed valves 110 and 170 (FIG. 12).

Fluid flows into the blind end 64 from the main gallery 220 through the third relief valve 180 and second three-way control valve 195. Because the blind end 64 requires more fluid than the fluid being evacuated from the rod end 62, make-up fluid is drawn from the reservoir 40 and passes through the fourth check valve 108 which is unseated by the flow.

Pressure flow is being exerted by the pump through the first relief valve 110 which is shifted open by return pressure and through the main gallery 220. So long as the user successfully works against the force exerted by the system 10, the valves 170 and 110 will remain open and fluid will be evacuated from the rod end 58. Should the user fail to move the rod 62 and the piston 66, back pressure will no longer exist and the valves 110 and 170 will shut due to the pilot flow from the proportional valve 130, thereby directing fluid pressurized flow from the pump 22 into the cylinder end 54 and moving the piston 66 in the direction D as shown in FIG. 12.

Figure 14:
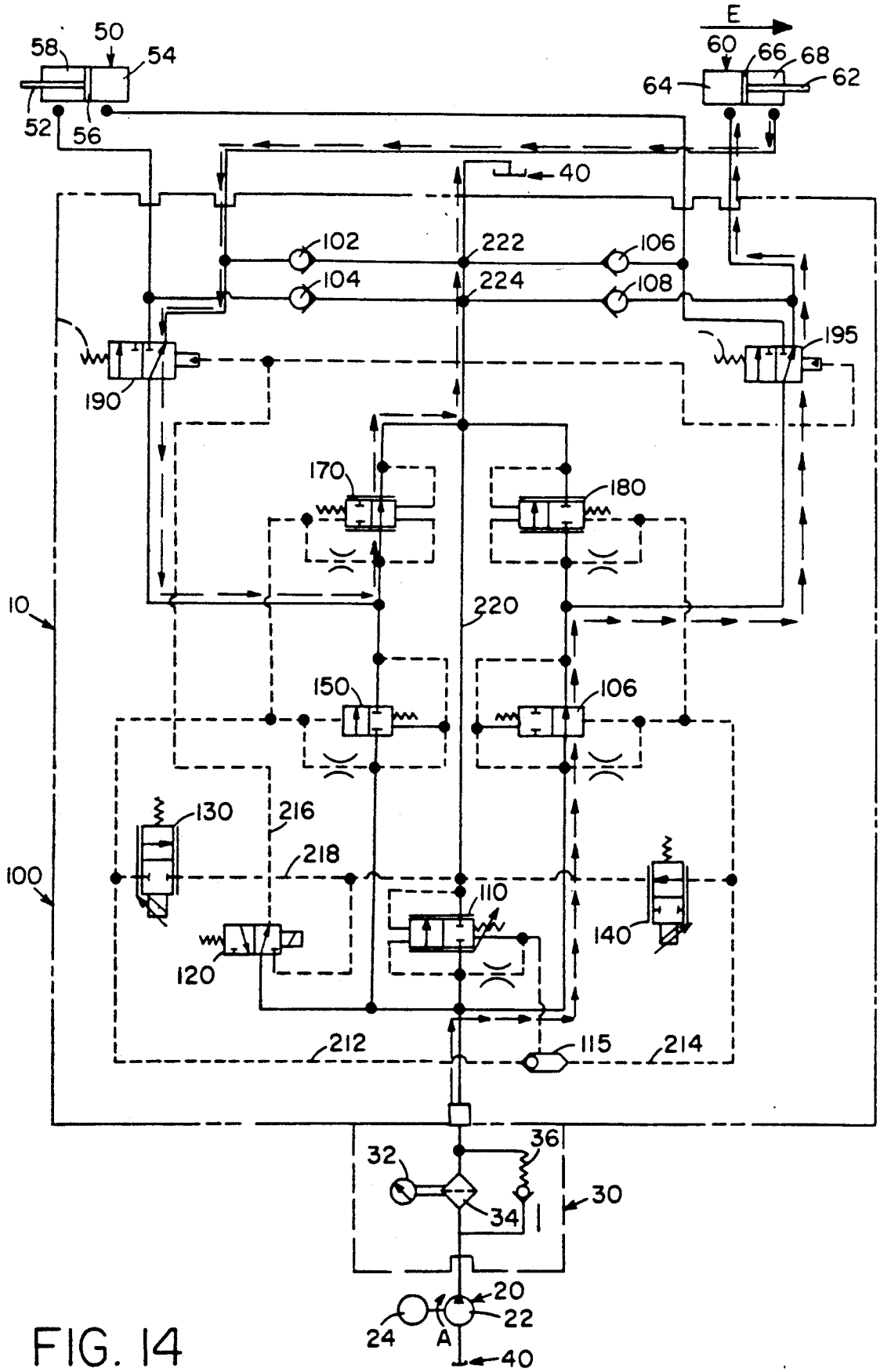
FIG. 14 is a schematic view of the hydraulic system of FIG. 1 with the system providing pressurized flow to the blind end of the leg hydraulics.

FIG. 14 shows the system 10 energized to channel pressurized flow from the pump 22 to the blind end 64 of the leg hydraulics 60. The description of FIG. 14 is similar to the description for FIG. 8 below wherein the system 10 channelled pressurize flow from the pump 22 to the blind end 54 of the arm hydraulics 50. The rod 62 in FIG. 14 is being forced in the direction E by the system 10 and the user may exercise against the rod 62 by counteracting the pressure exerted upon the piston 66.

As shown in FIG. 14 the system 10 is energized through the second proportional relief valve 140. The function and operation of the valve 140 was described below with respect to FIG. 8.

Figure 15:
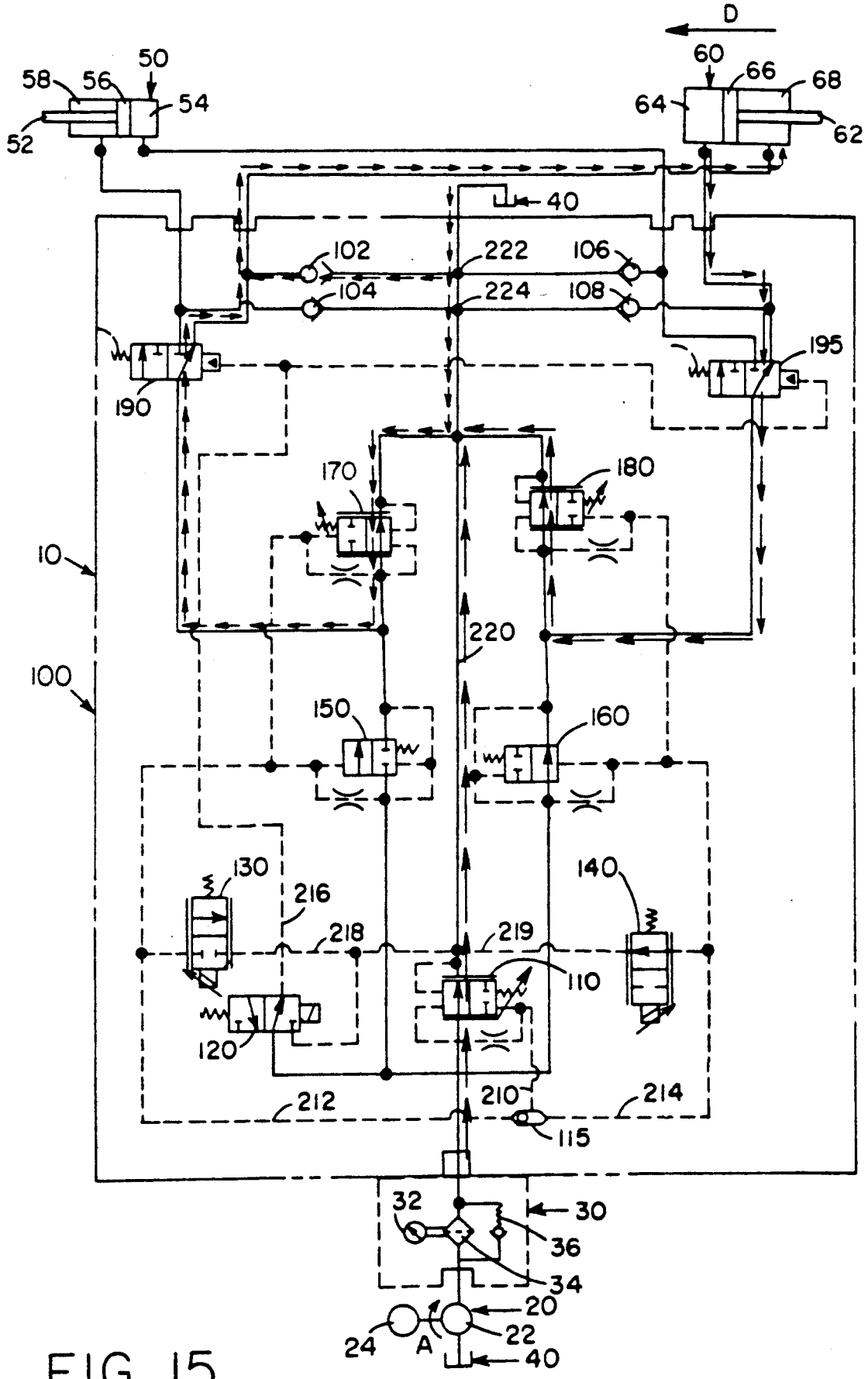
FIG. 15 is a schematic view of the hydraulic system of FIG. 1 with the user successfully overcoming the pressurized flow of FIG. 14.

FIG. 15 shows the system 10 with the user successfully working against the pressure in the blind end 64 of the hydraulic system 10 as shown in FIG. 14. The user in FIG. 15 is moving the piston 66 in the direction D against the pressure generated by the system 10.

The description and function of FIG. 15 is similar to the description and function of the system 10 as presented below with regard to FIG. 9. Specifically, in FIG. 15 the user has successfully generated pressure sufficient to overcome the pressurized flow into the blind end 64 of the leg hydraulic 60. At this time fluid flows out of the blind end 64 through the second control valve 195. This back pressure opens the first and third vented valves 110 and 180, because the back pressure generated by the user is greater than the pressure generated by the proportional valve 140 which had previously closed valves 110 and 180 (FIG. 14).

Fluid flows into the rod end 64 from the main gallery 220 through the second relief valve 170 and the first control valve 190. Pressure flow is being exerted from the pump 22 through the first relief valve 110 which is shifted open by return pressure and into the main gallery 220. So long as the user successfully works against the force exerted by the system 10, the valves 180 and 110 will remain open and fluid will be evacuated from the blind end 64. Should the user fail to move the rod 62 and the piston 66, back pressure will no longer exist and the valves 110 and 180 will shut due to the pilot flow from the proportional valve 140, thereby directing pressurized flow from the pump into the blind end 64 and moving the piston 66 in the direction E as shown in FIG. 14.

FIGS. 4, 5, 10 and 11 show the user positioning either the arm 12 or 13 to the initial set point while encountering little resistance to movement. This approach may be used when the weight or friction from movement of the arm 12 or 13 is negated as, for example, through counter-balancing. In the alternative, the system 10 may simulate the effect of "weightlessness" of the arm 12 or 13 while the initial set point is achieved by sending pressurized flow to the appropriate end of either of the hydraulics 50 or 60 at the pressure necessary to compensate for the weight and friction from movement of the arm 12 and 13.

Figure 16:
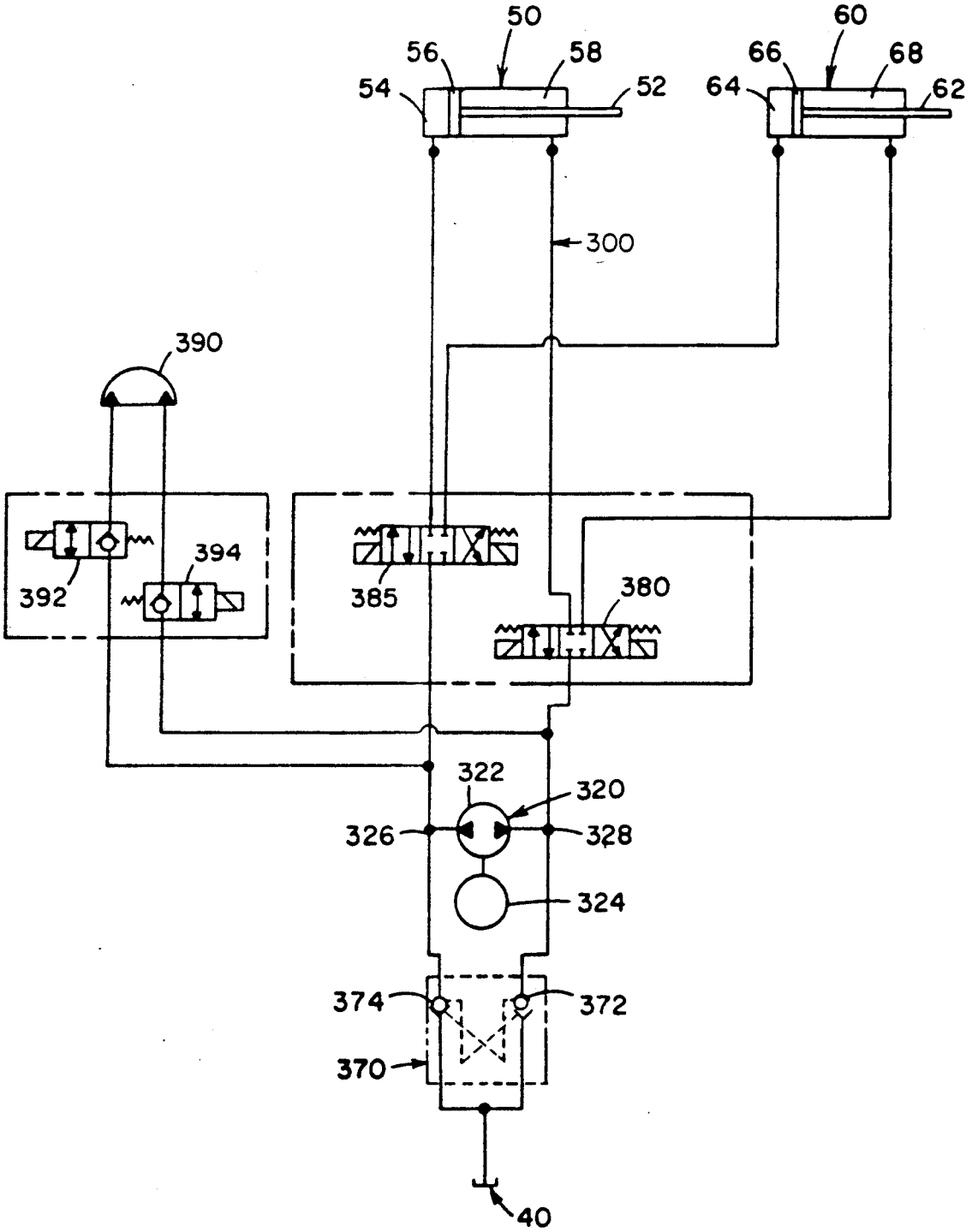
FIG. 16 is a schematic view of a second embodiment of the present invention wherein the hydraulic system is shut.

Refer now to FIG. 16 wherein is shown an alternate embodiment of the invention which is generally designated by numeral 310. The system 310 is generally comprised of the pump assembly 320, the reservoir 40, the arm hydraulics 50, the leg hydraulics 60, the first and second control valves 380 and 385, respectively, the double pilot operated check valve 370, the rack and pinion actuator 390 and the first and second normally closed two-way valves 392 and 394, respectively.

FIG. 16 shows the system 310 at rest. The motor 324 is not turning the bi-rotational pump 322 in either direction. The pump 322 has a left-hand port 326 and a right-hand port 328. The directional control valves 380 and 385 are shut thereby prohibiting the movement of fluid to the arm hydraulics 50 and leg hydraulics 60. Further, the check valves in the two-way valves 392 and 394 are shut thereby prohibiting fluid movement in or out of the rack and pinion 390. Thus, the rack and pinion actuator 390 and the arm hydraulics 50 and the leg hydraulics 60 are locked in position.

Figure 17:
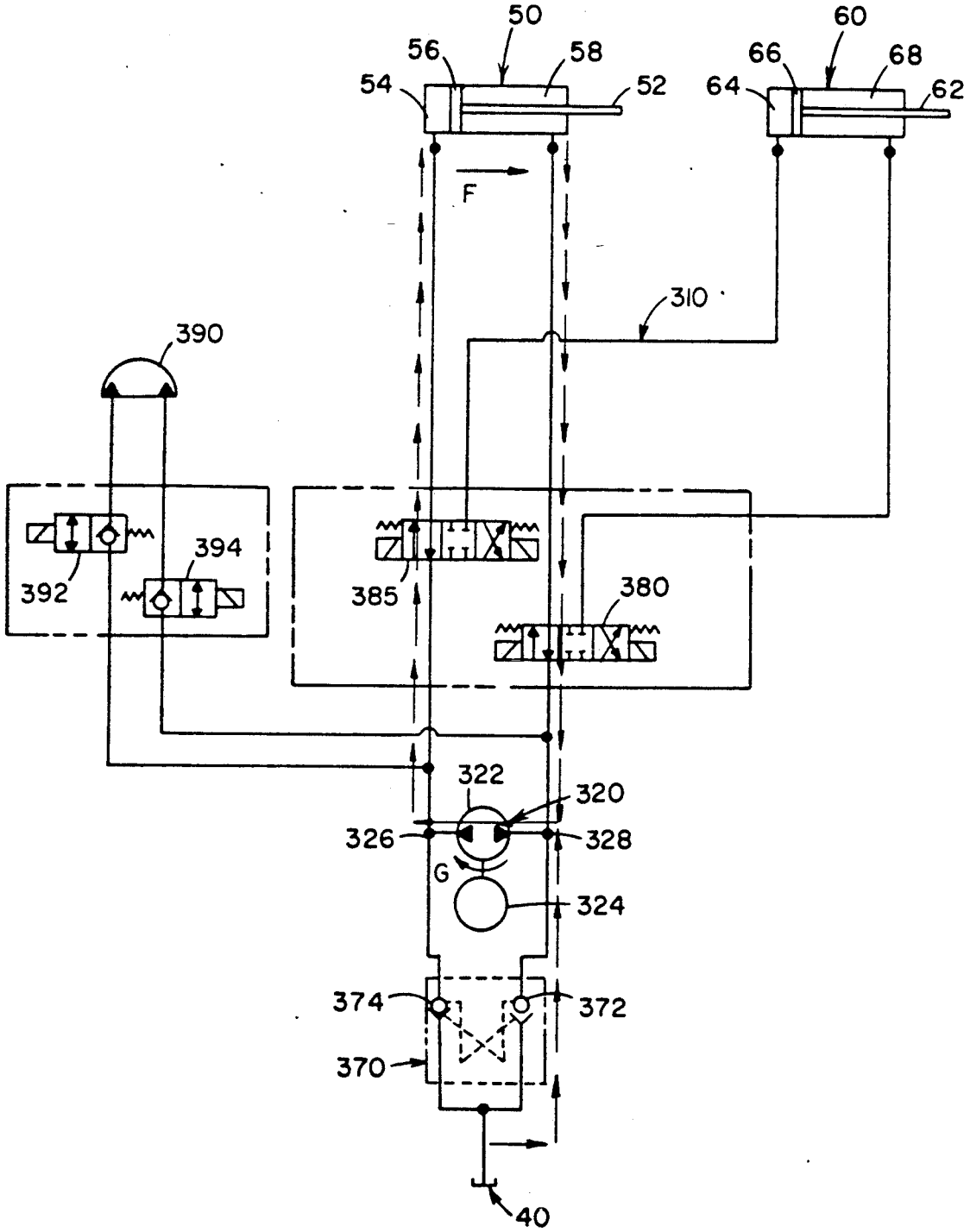
FIG. 17 is a schematic view of the system of FIG. 16 wherein the system is providing pressurized flow to the blind end of the arm hydraulics.

FIG. 17 shows the system 310 energized so as to exert a pressure upon the piston 56 and moving the rod 52 in the direction F. Thus, the rod 52 is being forced in the direction F by the system 310 and the user may exercise against the rod 52 by working against the pressure exerted upon the piston 56. Both the direction of the force being exerted by the system 310 and the direction of movement of the piston 56 are in the direction F.

As shown in FIG. 17 the system 310 is energized through the second control valve 385. The electronic controls 11 actuate the solenoid within the control valve 385 to open the blind end 54 to the pump assembly 320. As also shown in FIG. 17 the electronic controls 11 have actuated the motor 324. The motor 324 is turning the bi-directional pump 322 in a clock wise direction designated as direction G. Simultaneously, the electronic controls 11 have actuated the solenoid in the first control valve 380 so as to open the valve 380 to enable fluid being evacuated from the rod end 58 to flow to right-hand port 328 of the pump 322.

Thus, fluid may flow from the rod end 58 through the port 328, through the pump 322, through the port 326 and into the blind end 54 of the arm hydraulics 50.

The amount of pressure exerted by the pump 322 and the speed with which the rod 52 will be moved is determined by the amount of amperage and voltage sent to the motor 324 by the electronic controls 11. In this way the electronic controls 11 set the amount of pressure and thereby the force the user must overcome to exercise against the system 310. In addition, the electronic controls 11 can also set the rotational direction and the speed of the arm 12 which is connected to the rod 52.

Figure 18:
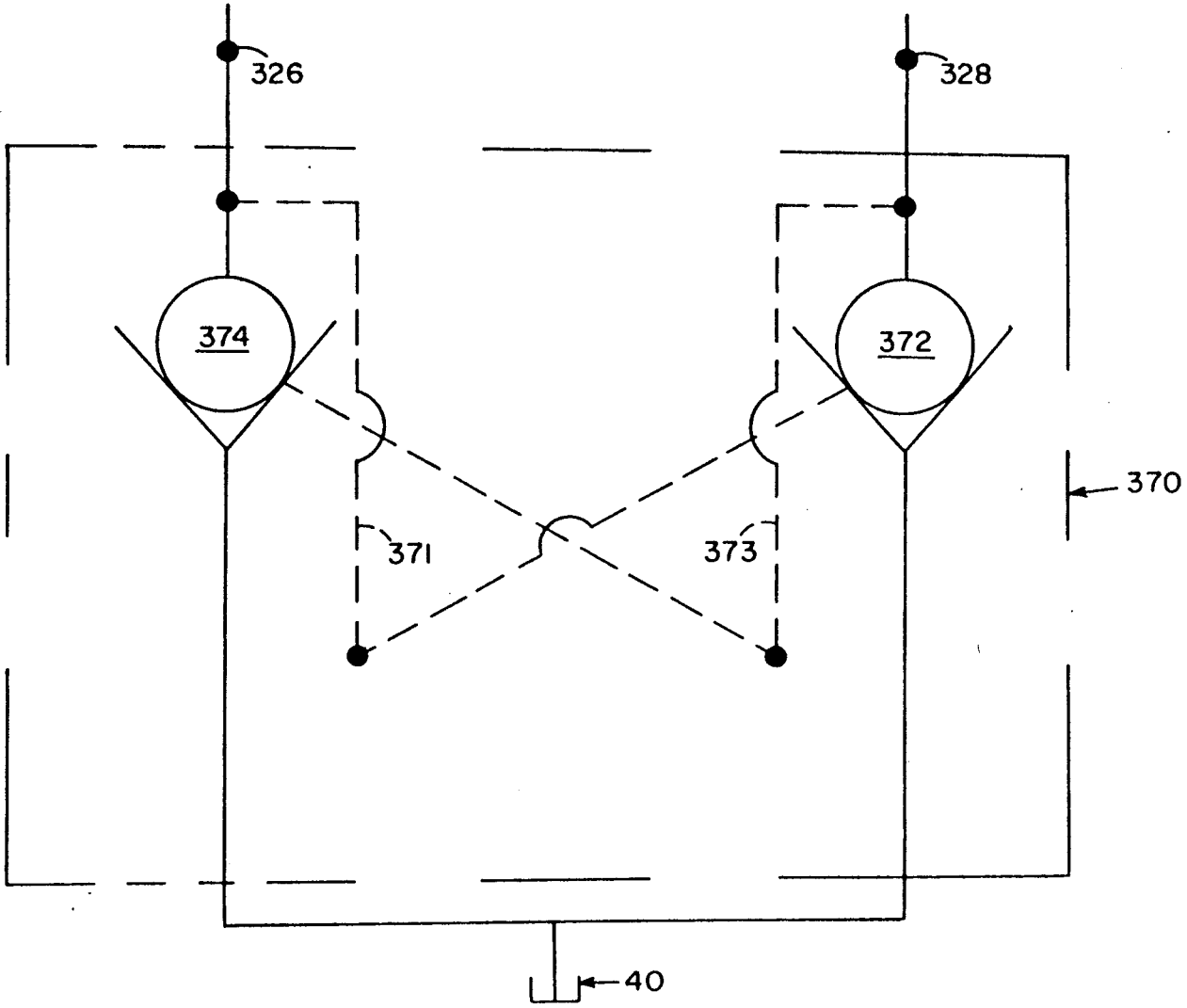
FIG. 18 is a schematic view of the double pilot operated check valve of the system of FIG. 16.

Because the blind end 54 requires make-up fluid to compensate for the space taken up by the rod 52 in the rod end 58, as shown in FIG. 17 fluid is drawn from the reservoir 40. Specifically, the pressurized flow from port 326 unseats and locks open the right-hand check valve 372 of the double pilot operated check valve 370. FIG. 18 shows the double pilot operated check valve 370 in detail. The valve 370 will be opened if the pressure drop between ports 326 and 328 equals or exceeds 4 psi. The double pilot operated check valve 370 has two galleries 371 and 373. Each gallery 371 and 373 connects one side of the double pilot operated check valve 370 to the opposite or opposing check valve 372 and 374. For example, the gallery 371 connects the left-hand port 326 to the right-hand check valve 372 while the other gallery 373 connects the right-hand port 328 to the left-hand check valve 374. Each gallery 371 and 373 houses a piston with a rod that has a seal around the piston. When pressurized the piston unseats the check valve which provides an open path to the reservoir 40. Accordingly, if there is sufficiently high pressure in port 326 as compared to port 328 the check valve 372 will be unseated as shown in FIG. 17. This enables fluid to be drawn from the reservoir 40 to the right-hand port 328 and eventually to the blind end 54 to provide the make-up fluid required by the system 310.

Figure 19:
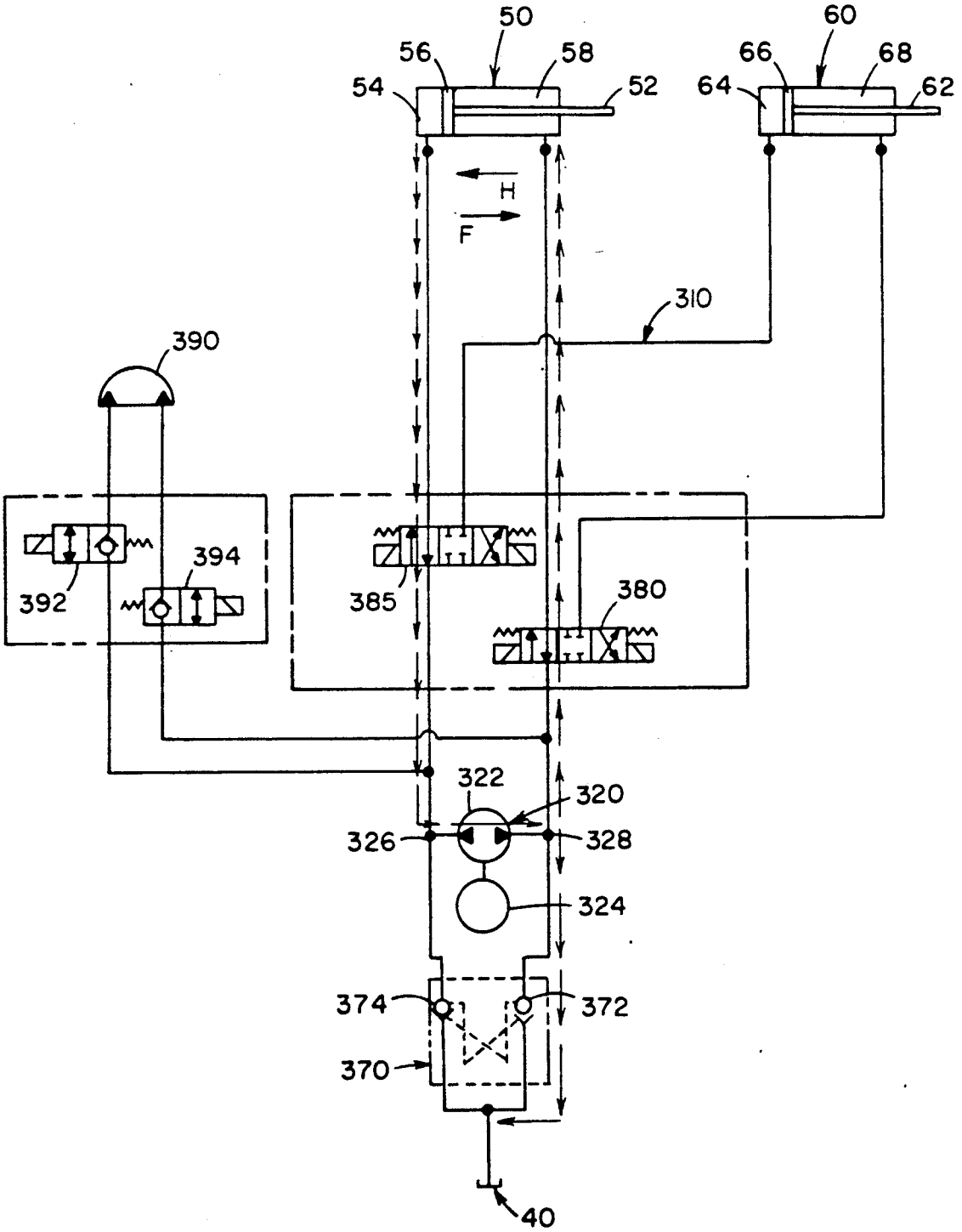
FIG. 19 is a schematic view of the hydraulic system of FIG. 16 wherein the user is successfully exercising against the pressurized flow of FIG. 17.

FIG. 19 shows the user exerting force on the rod 52 in the direction H and successfully overcoming the pressure of the pump 322 thereby moving the rod 52 and piston 56 in the direction H in the hydraulics 50. Thus, the user is exercising against the system 310. When the user successfully overcomes the pressure of the pump 322, fluid is evacuated from the blind end 54 and is routed to the rod end 58. This is accomplished by the pressure exerted by the user unseating the check valve 372 in the double pilot operated check valve 370 thereby opening the rod end 58 to the reservoir 40. Extra fluid from the blind end 54 enters the reservoir 40 through the open check valve 372. Thus, the direction of the force being exerted by the system 310 is in the direction F and the direction of motion of the piston 56 is in the direction H.

Figure 20:
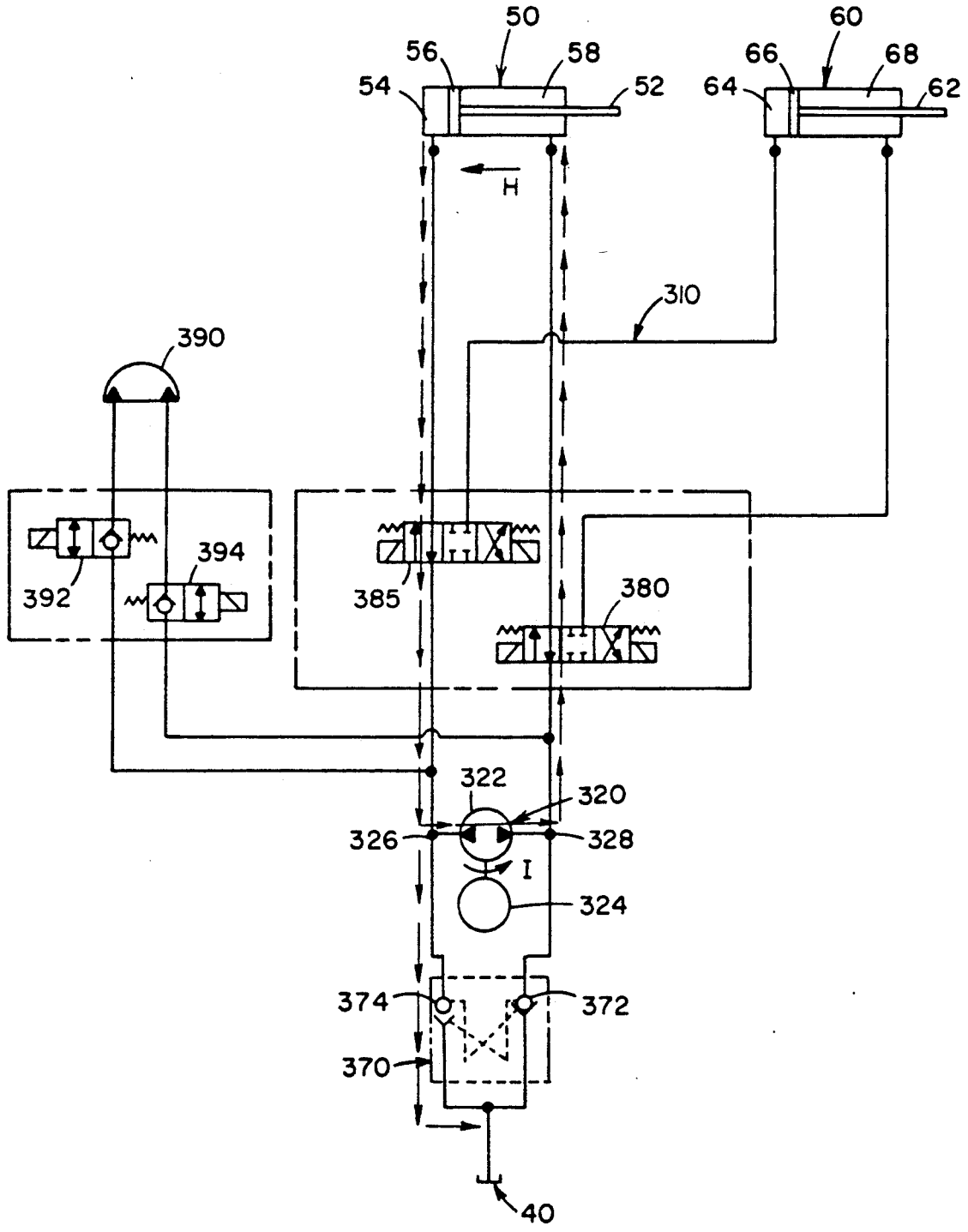
FIG. 20 is a schematic view of the hydraulic system of FIG. 16 wherein the system is providing pressurized flow to the rod end of the arm hydraulics.

FIG. 20 shows the system 310 energized so as to exert a pressure upon the piston 56 and move the rod 52 in the direction H. Thus, the rod 52 is being forced in the direction H by the system 310 and the user may exercise against the rod 52 by working against the pressure exerted upon piston 56. So the direction of force from the system 310 and the direction of movement of the piston 56 are both in the direction H.

The electronic controls 11 actuate the solenoid within the control valves 380 and 385 to open the rod end 58 and blind end 54 to the pump assembly 320. As also shown in FIG. 20 the electronic controls 11 have actuated to the pump assembly 320 and the motor 324. The motor 324 is turning the bi-directional pump 322 in a counter clockwise direction designated as direction I. Fluid may flow from the blind end 54 through the port 326 through the pump 322 through the port 328 and into the rod end 58 of the arm hydraulics 50.

Because the rod end 54 requires less fluid to fill due to the presence of the rod 52, as shown in FIG. 20 extra fluid is sent to the reservoir 40. Specifically, the pressurized flow from the port 328 unseats and locks open the left-hand check valve 374 of the double pilot operated check valve 370.

The amount of pressure exerted by the pump 322 and the speed with which the rod 52 will be moved may be determined by the amount of amperage and voltage respectively sent to the motor 324 by the electronic controls 11. The electronic controls 11 may set the amount of pressure and thereby the force the user must overcome to exercise against the system 310 and the user will set the speed.

Figure 21:
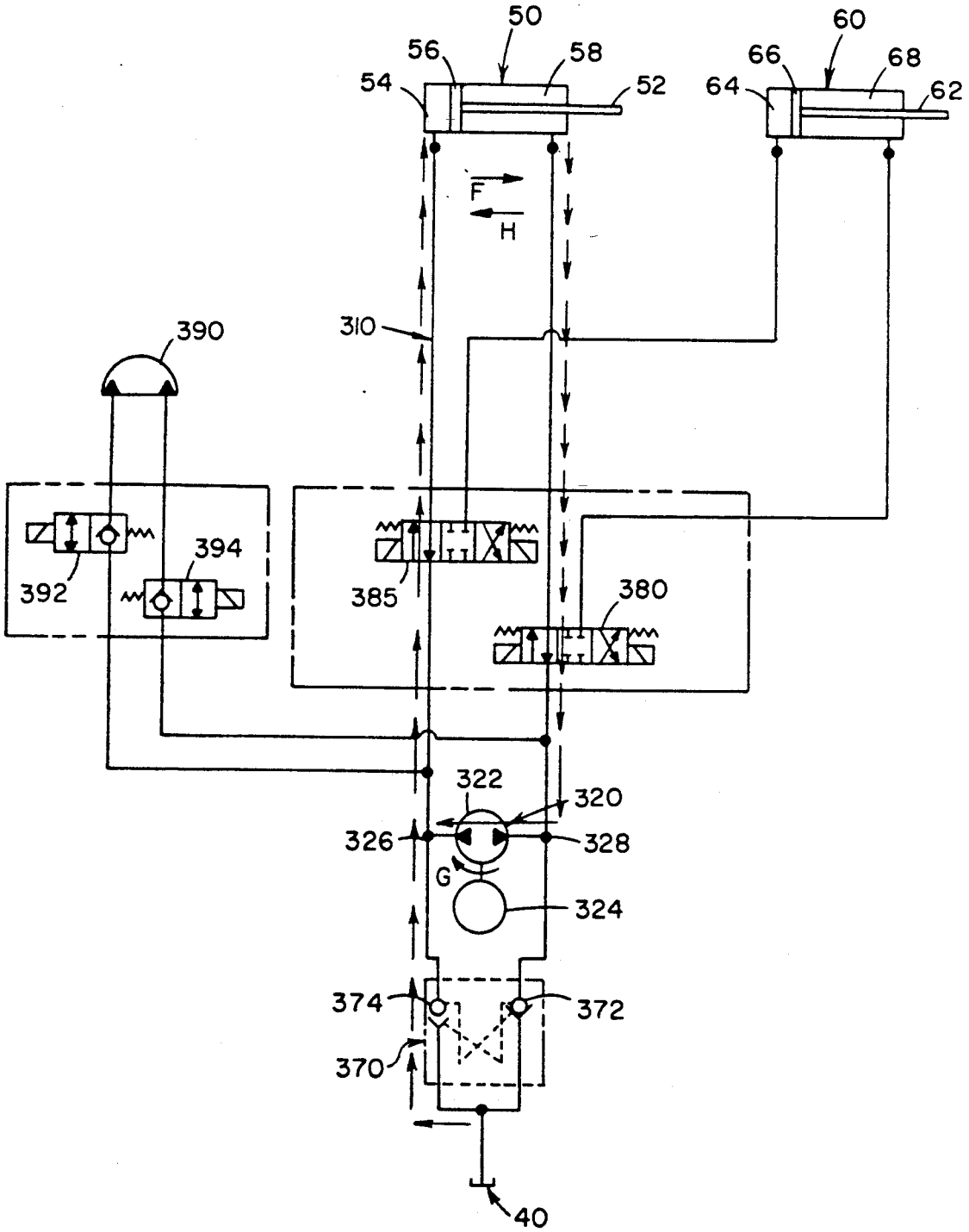
FIG. 21 is a schematic view of the hydraulic system of FIG. 16 wherein the user is successfully exercising against the pressurized flow of FIG. 20.
Figure 22:
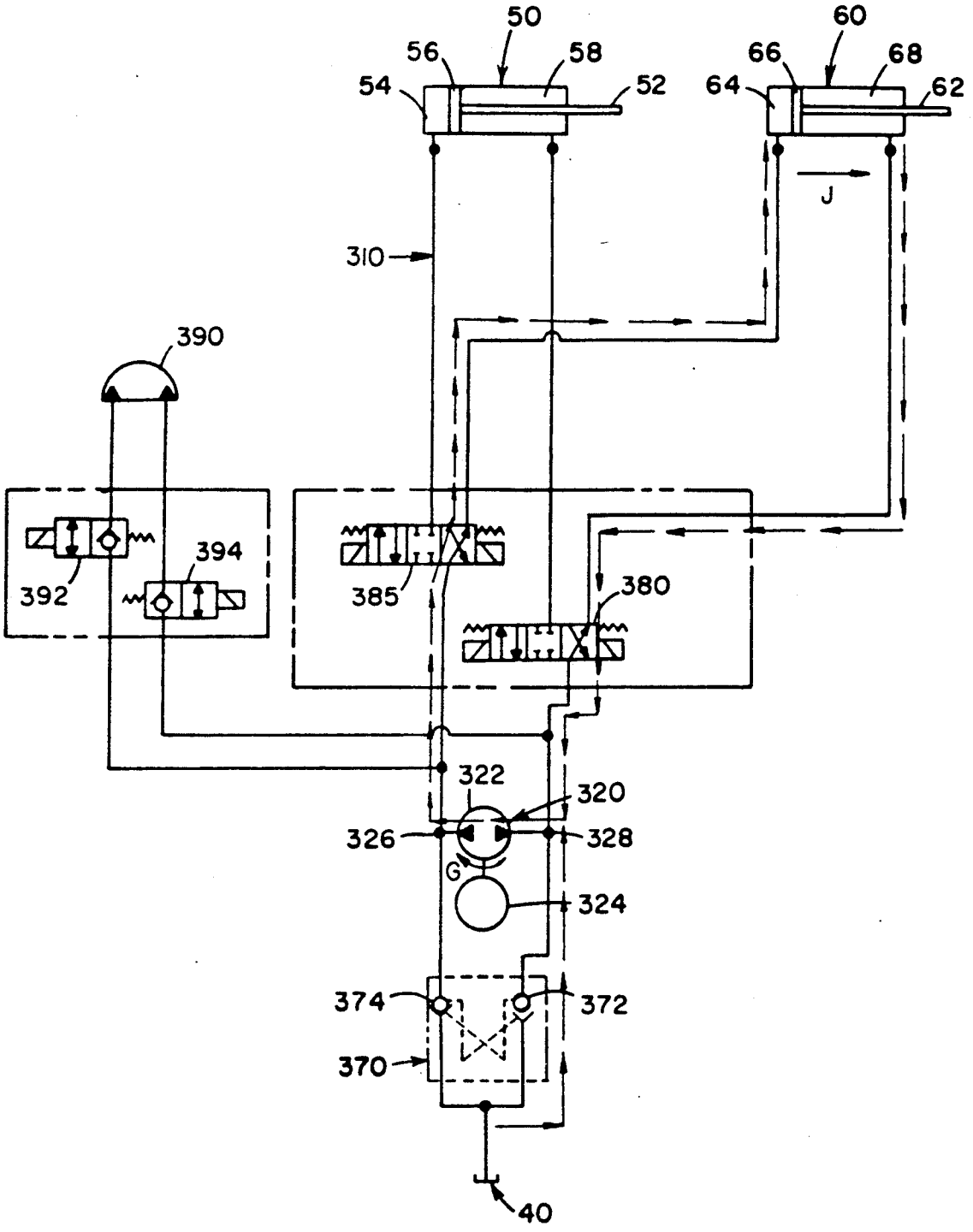
FIG. 22 is a schematic view of the hydraulic system of FIG. 16 wherein the system is providing pressurized flow to the blind end of the leg hydraulics.

FIG. 21 shows the system 310 pressurized and the user successfully overcoming the pressure by moving the rod 52 and piston 56 in the direction F against the pressure at the pump assembly 320. The pressure created by the user unseats the check valve 374 and this enables make-up fluid to be drawn from the reservoir 40. Thus the force from the system 310 is in the direction H while the direction of motion of the piston 56 is in the direction F.

Figure 23:
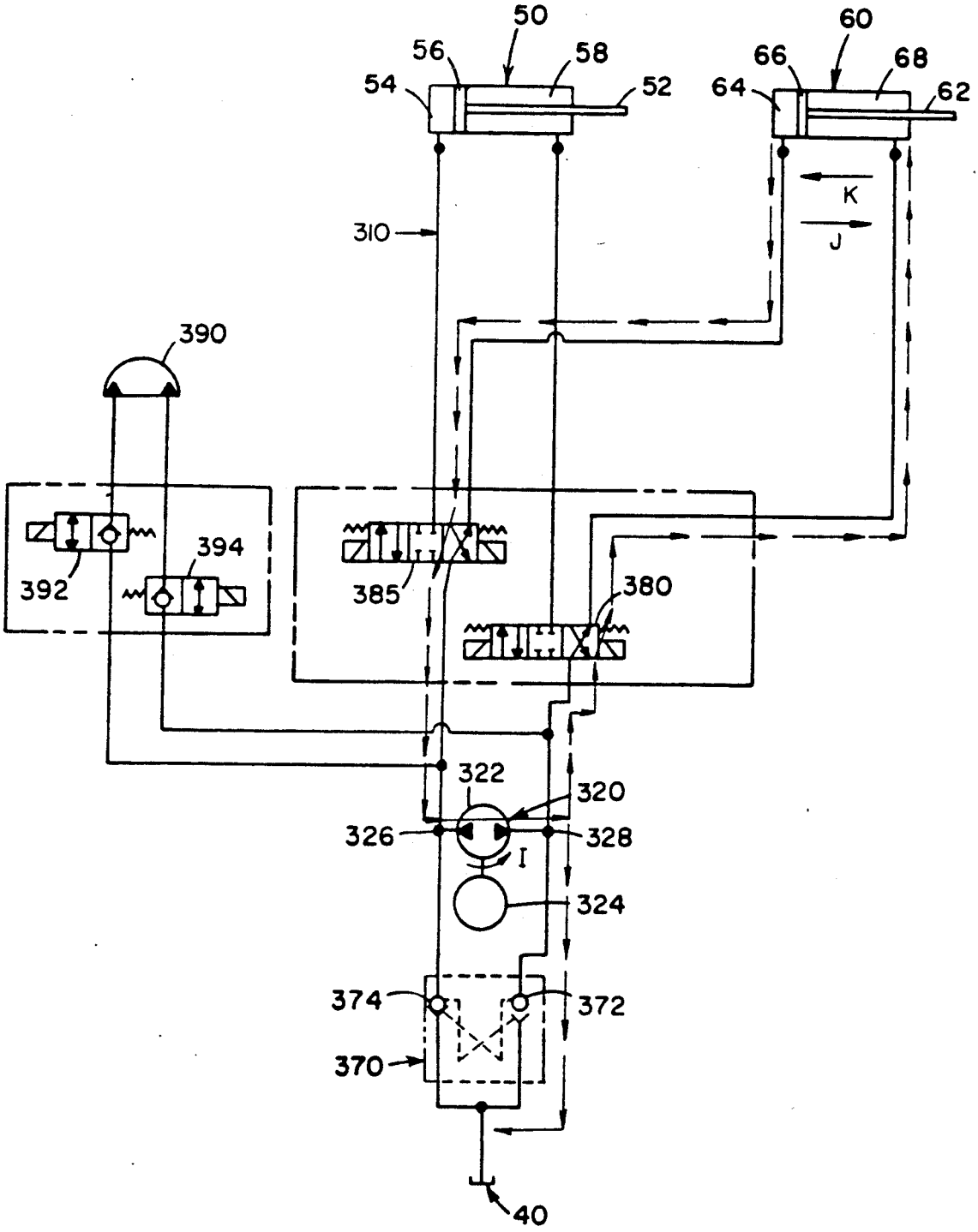
FIG. 23 is a schematic view of the hydraulic system of FIG. 16 wherein the user is successfully exercising against the pressurized flow of FIG. 22.
Figure 24:
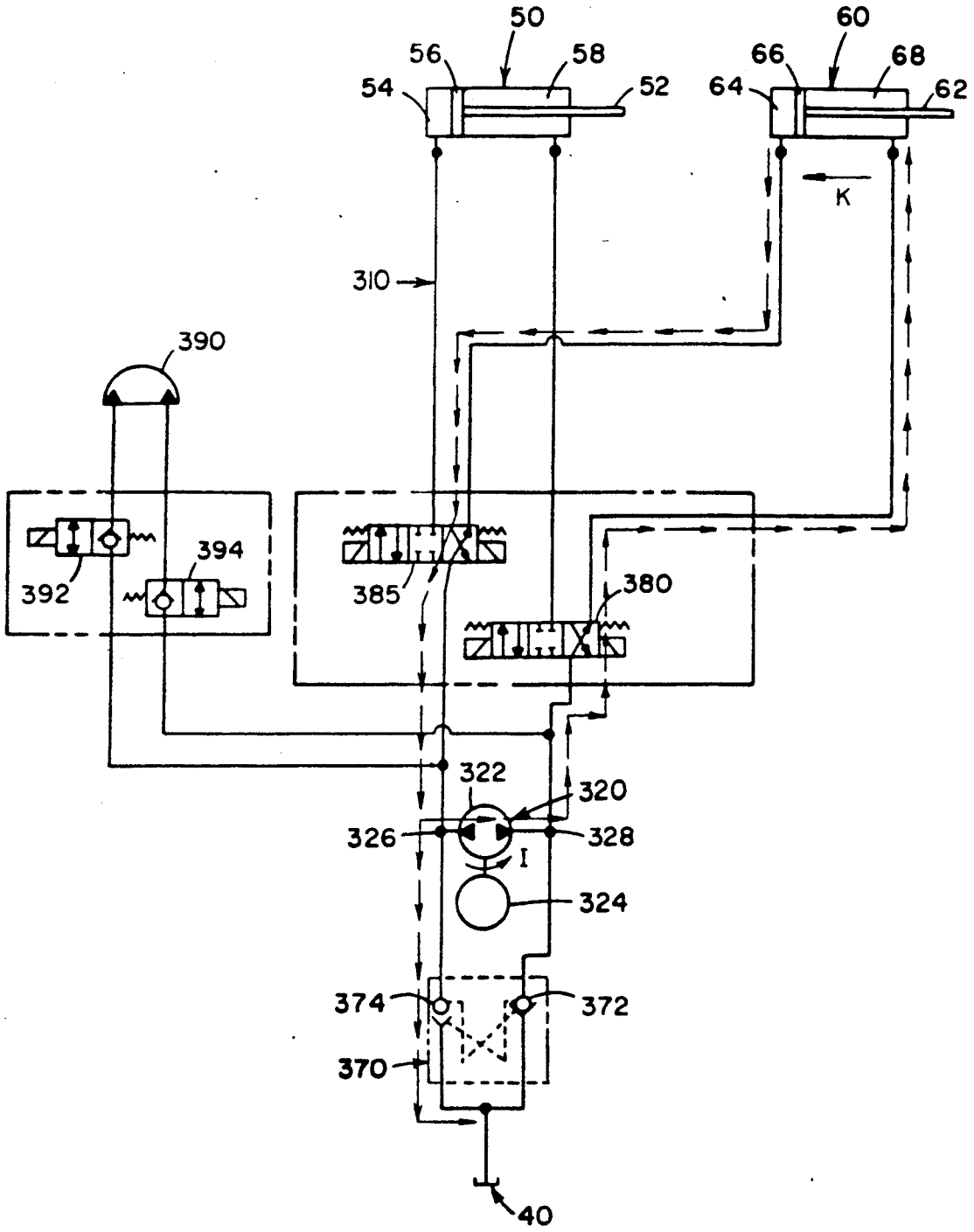
FIG. 24 is a schematic view of the hydraulic system of FIG. 16 wherein the system is providing pressurized flow to the rod end of the leg hydraulics.
Figure 25:
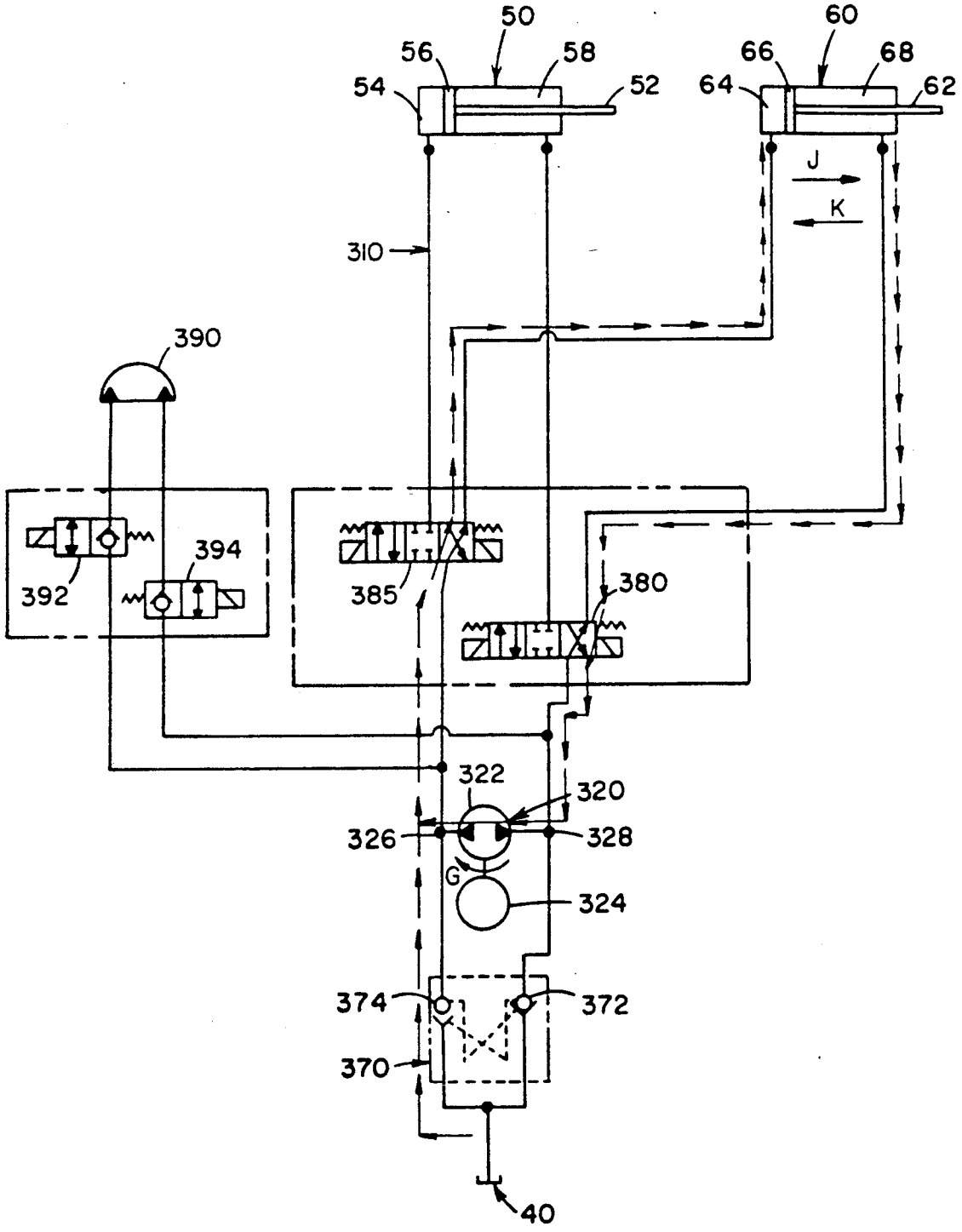
FIG. 25 is a schematic view of the hydraulic system of FIG. 16 wherein the user is successfully exercising against the pressurized flow of FIG. 24.

FIGS. 22 to 25 show the system 310 connected to the leg hydraulics 60 rather than to the arm hydraulics 50 as shown in FIGS. 17 and 19 to 21. Specifically, in FIG. 22 the control valves 380 and 385 are shifted so that the leg hydraulics 60 are connected to the pump assembly 320 to direct pressurized flow to the blind end 64 in the same manner as described with regard to FIG. 17 above (both force and motion in direction J). In FIG. 23 the valves 380 and 385 are shifted to show the user exercising against the pressurized flow to blind end 64 in a similar manner as described above with regard to FIG. 19 (force in direction J, motion in direction K). FIG. 24 shows the control valves 380 and 385 shifted to direct pressurized flow to the rod end 68 in a similar manner as described above with regard to FIG. 20 (both force and motion in direction K). FIG. 25 shows the control valves 380 and 385 shifted to allow the user to exercise against the pressurized flow of FIG. 24 in a manner similar to FIG. 21 above (force in direction K, motion in direction J). Thus pressurized flow may be directed to either end 64 or 68 of the leg hydraulics 60 and the user may exercise against the pressurized flow.

FIGS. 19, 21, 23 and 25 also show the configuration of the system 310 wherein the user is establishing the set point to begin exercising. The user grasps either the lever arm 12 or the lower body exerciser arm 13 and presses the set button. This elicits a command from the electronic controls 11 that instructs the arm 12 or 13 that it weighs zero pounds. This is accomplished by the system 310 sending pressurized flow to the appropriate end of either of the hydraulics 50 or 60 at the pressure necessary to compensate for the weight and friction from movement of the arm 12 or 13. At this time, the user can, with little difficulty, move the rod 52 or 62 to the position of choice within the arm hydraulics 50 or leg hydraulics 60. At that point the user would disengage the set button and the set point would be achieved.

Figure 26:
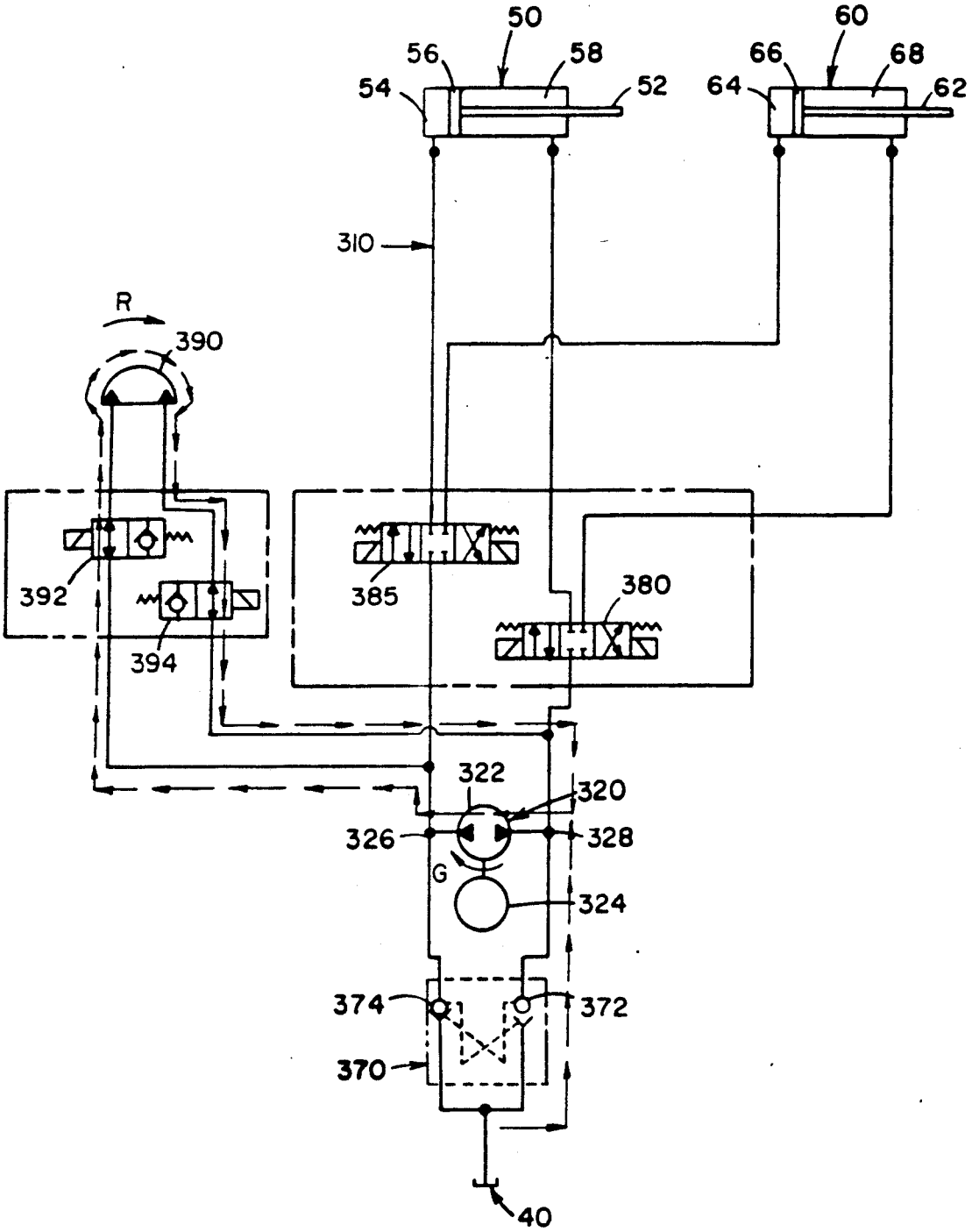
FIG. 26 is a schematic view of the hydraulic system of FIG. 16 rotating a rack and pinion actuator.

FIG. 26 shows the system 310 configured to exert a pressure upon the rack and pinion actuator 390 and thereby rotate the actuator 390 in the direction R. The hydraulics 50 and 60 have been shut off by the electronic controls 11 sending a signal to the control valves 380 and 385 to close the hydraulics 50 and 60 from the pump 322. In addition, the electronic controls 11 have opened both first and second normally closed two-way valves 392 and 394, respectively. The electronic controls 11 have also actuated the motor 324 thereby turning the pump 322 in the direction G. This creates a pressure drop from the port 328 to the port 326 and fluid may flow from the port 326 through the valve 392 across the rack and pinion actuator 390, through the valve 394, to the port 328 and back into the pump 322. The pressure in the port 326 has unseated the check valve 372 of the double pilot operated check valve 370 thereby exposing the reservoir 340 to the pump 322. In order for the rack and pinion actuator 390 to be turned in the opposite direction, the electronic controls 11 need only reverse the motor 324 thereby rotating the pump 322 in the opposite direction of G which would create a pressure drop in the opposite direction of the ports 326 and 328. In this instance the check valve 374 of the double pilot operated check valve would be unseated and the fluid would flow in the opposite direction, thereby rotating the actuator 390 in the direction opposite of the direction R.

Figure 27:
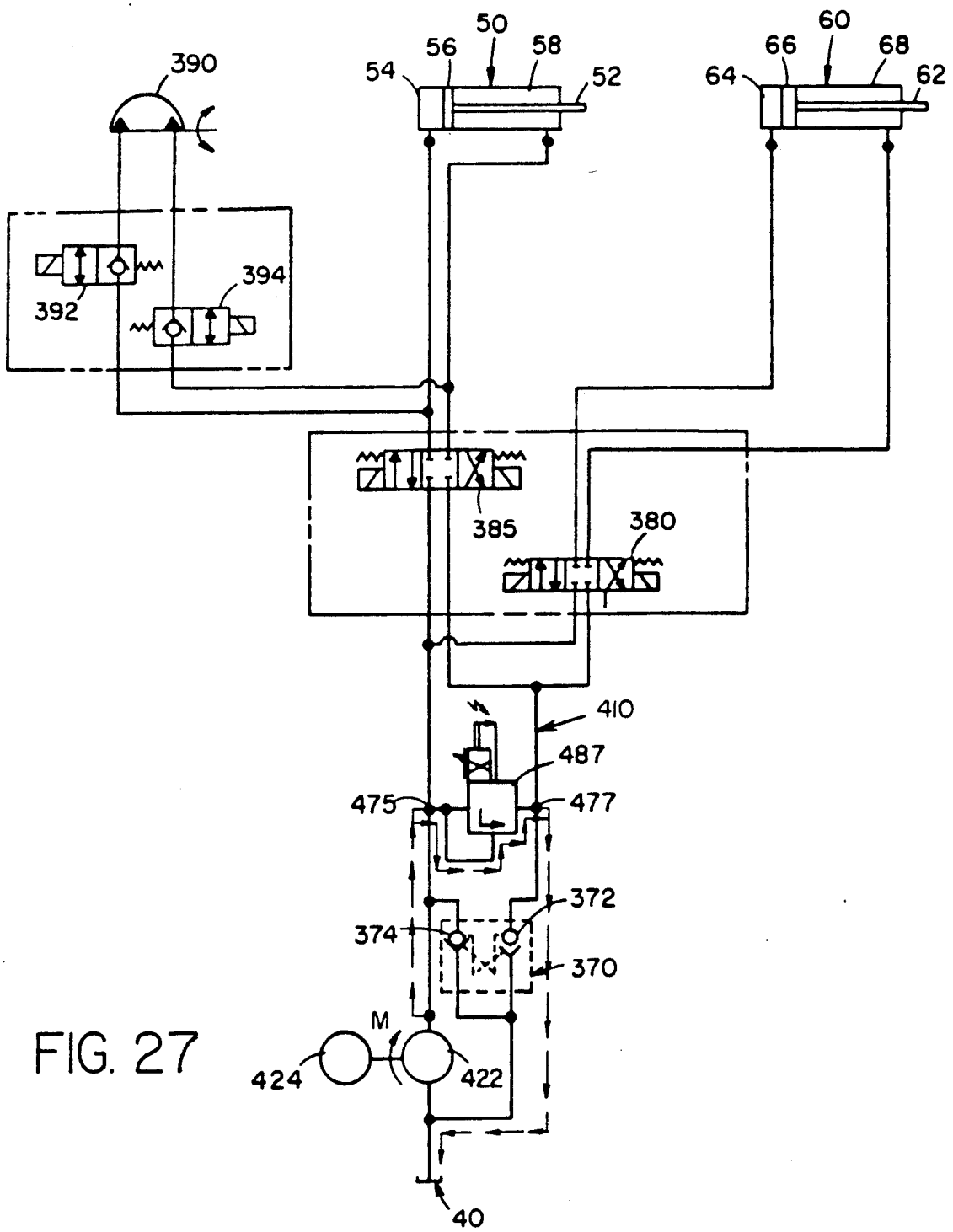
FIG. 27 is a schematic view of a third embodiment of the present invention wherein the hydraulic system is idling.

Refer now to FIG. 27 wherein is shown another alternate embodiment of the invention which is generally designated by numeral 410. The system 410 is generally comprised of the pump assembly 420, the reservoir 40, the arm hydraulics 50, the leg hydraulics 60, the first and second control valves 380 and 385, respectively, the proportional pressure relief valve 487, the rack and pinion actuator 390, the first and second normally closed two-way valves 392 and 394, respectively and the double pilot operated check valve 370.

FIG. 27 shows the system 410 at rest with the pump assembly 420, including the motor 424 and pump 422, circulating fluid through the open relief valve 487 back to the reservoir 40. The control valves 380 and 385 are in their normally closed position and the arm and leg hydraulics 50 and 60 are inactive.

Figure 28:
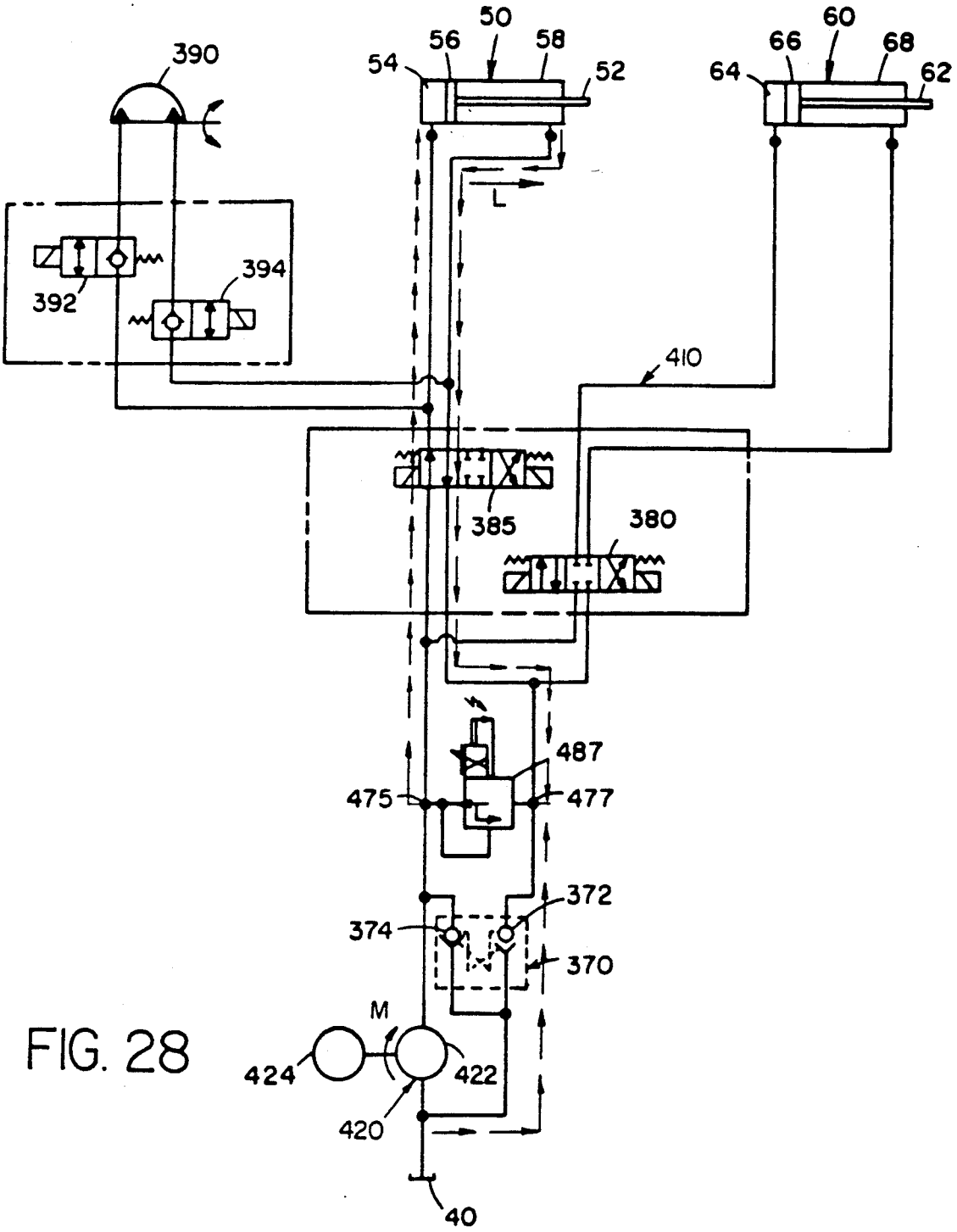
FIG. 28 is a schematic view of the hydraulic system of FIG. 27 providing pressurized flow to the blind end of the arm hydraulics.

FIG. 28 shows the system 410 energized so as to exert a pressure upon the piston 56 and move the rod 52 in the direction L. The user may exercise against the rod 52 by working against the pressure exerted upon the piston 56. Thus the direction of force and movement of piston 56 are both in the direction L.

Electronic controls 11 actuate the solenoid within the control valve 385 to open the blind end 54 to the pump assembly 420. The electronic controls 11 have also actuated the motor 424. The motor 424 is turning the uni-directional pump 422 in a clock wise direction designated as direction M. The second control valve 385 also connects the rod end 58 of the arm hydraulics 50 to the reservoir 40. Thus, fluid may readily evacuate the rod end 58 and no cavitation is experienced by the system.

The pressure column from the pump 422 has unseated the right-hand check valve 372 of the double pilot operated check valve 370. Excess fluid may flow from the reservoir 40 to the blind end 54.

The current and voltage input from the electronic controls 11 to the force coil in the proportional pressure relief valve 487 is set by the electronic controls 11. In response to the current and voltage excitation the force current moves the spool of the proportional valve 487 to a tension commensurate with the amount of current excitation. It is this tension within the valve 487 which the user must overcome.

Figure 29:
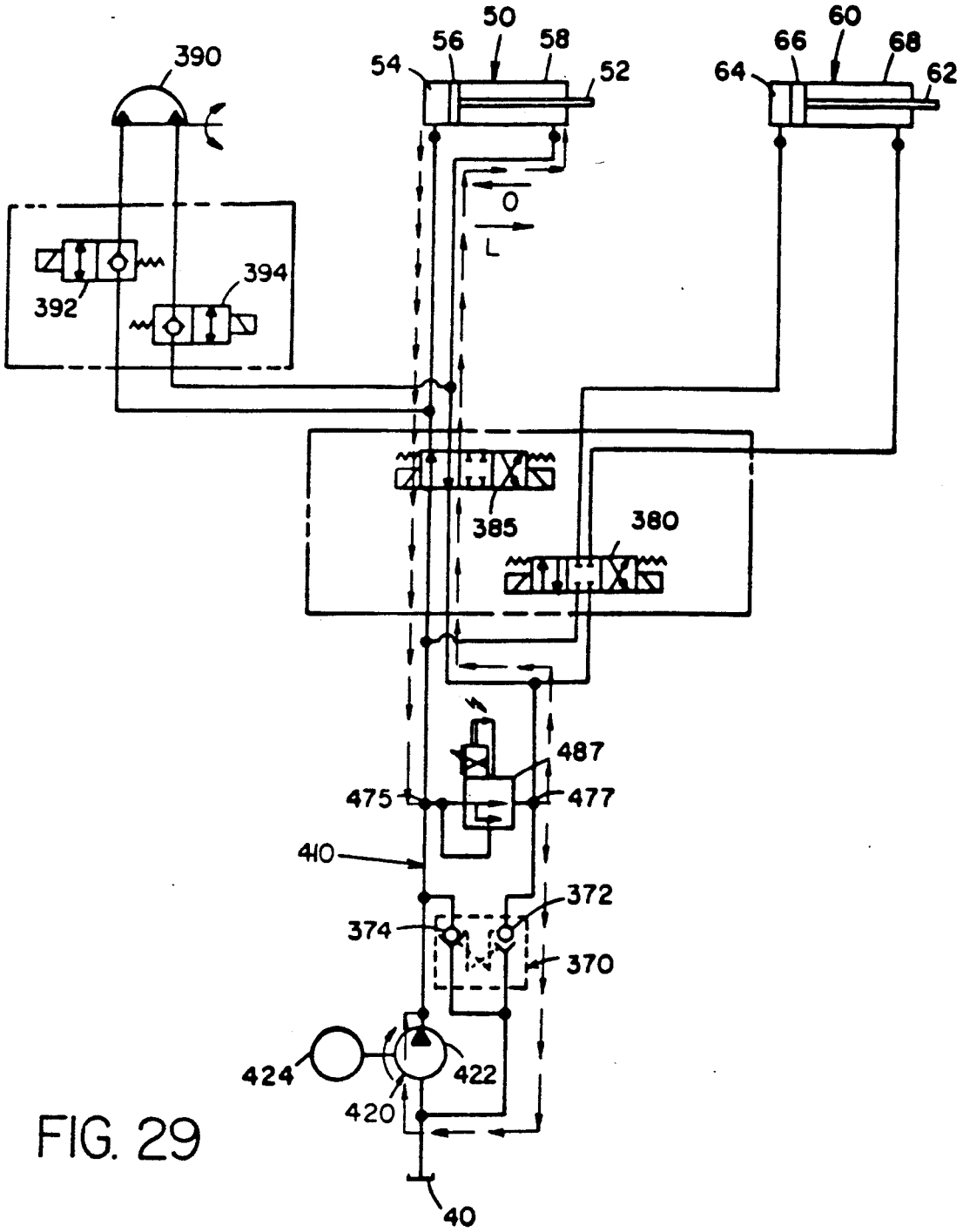
FIG. 29 is a schematic view of the hydraulic system of FIG. 27 wherein the user is successfully exercising against the pressurized flow of FIG. 28.

FIG. 29 shows the user successfully overcoming the pressure shown in FIG. 28 by moving the rod 52 and the piston 56 in the direction O. As shown in FIG. 29, the pressure created by the user in the blind end 54 has overcome the tension in the proportional valve 487 and accordingly fluid may flow through the valve 487 from the blind end 54 to the rod end 58 of the hydraulics 50. Because the rod end 58 requires less fluid as compared to the blind end 54 as the piston 56 is moved in the direction O, the excess fluid is channeled to the reservoir 40 via the unseated check valve 372 of the double pilot operated check valve 370. The check valve 372 is unseated by the pressure in port 475 created by the user. Thus the direction of force from the system 410 is L and the direction of motion of the piston 56 is O.

Figure 30:
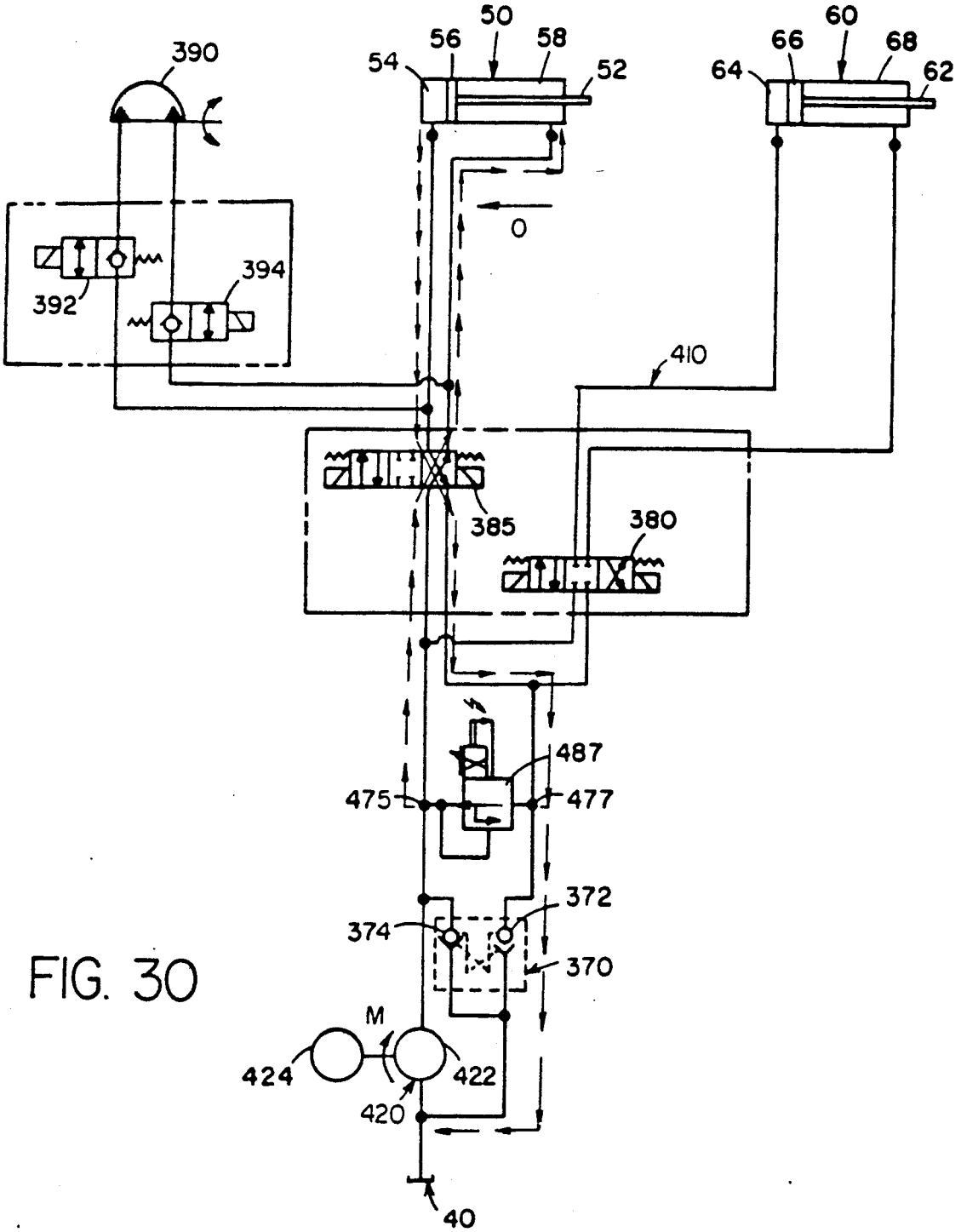
FIG. 30 is a schematic view of the hydraulic system of FIG. 27 wherein the system is providing pressurized flow to the rod end of the arm hydraulics.

FIG. 30 shows the system 410 with the pump assembly 420 energized so as to exert a pressure upon the piston 56 and move the rod 52 in the direction O. Thus, the rod 52 is being forced, in the direction O by the pump assembly 420 and the user may exercise against the rod 52 by working against the pressure. Both the direction of force from the system 410 and the direction of motion of the piston 56 is the direction O.

Electronic controls 11 actuate the solenoid within the control valve 385 to open the rod end 54 to the pump assembly 420. The electronic controls 11 have actuated the motor 424. The motor 424 is turning the uni-directional pump 422 in a clock wise direction designated as direction M. The second control valve 385 also connects the blind end 58 of the arm hydraulics 50 to the reservoir 40. Thus, fluid may readily evacuate the blind end 54 and no cavitation is experienced by the system 410. The pressure column from the pump 422 has unseated the right-hand check valve 372 of the double pilot operated check valve 370. Because less fluid is required in the rod end 58 as compared to the blind end 54, the unseating of the right-hand check valve 372 enables excess fluid to return to the reservoir 40.

The proportional pressure relief valve 487 regulates the pressure and speed of flow. Specifically, the current and voltage input is set by the electronic controls 11 to the force coil in the proportional pressure relief valve 487. In response to the current and voltage excitation, the force current moves the spool of the proportional valve 487 to a tension commensurate with the amount of current excitation. It is this tension within the valve 487 which the user must overcome.

Figure 31:
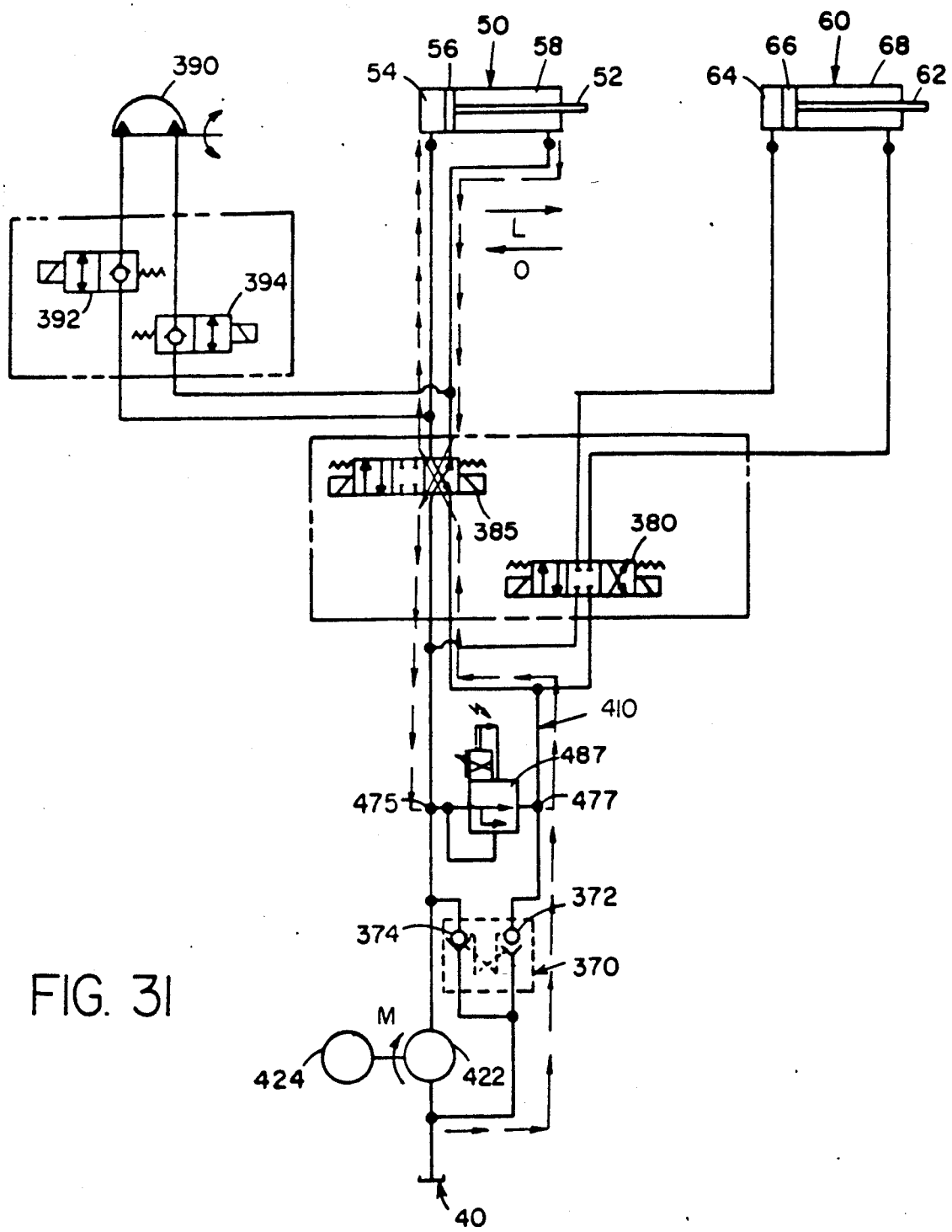
FIG. 31 is a schematic view of the hydraulic system of FIG. 27 wherein the user is successfully exercising against the pressurized flow of FIG. 30.
Figure 32:
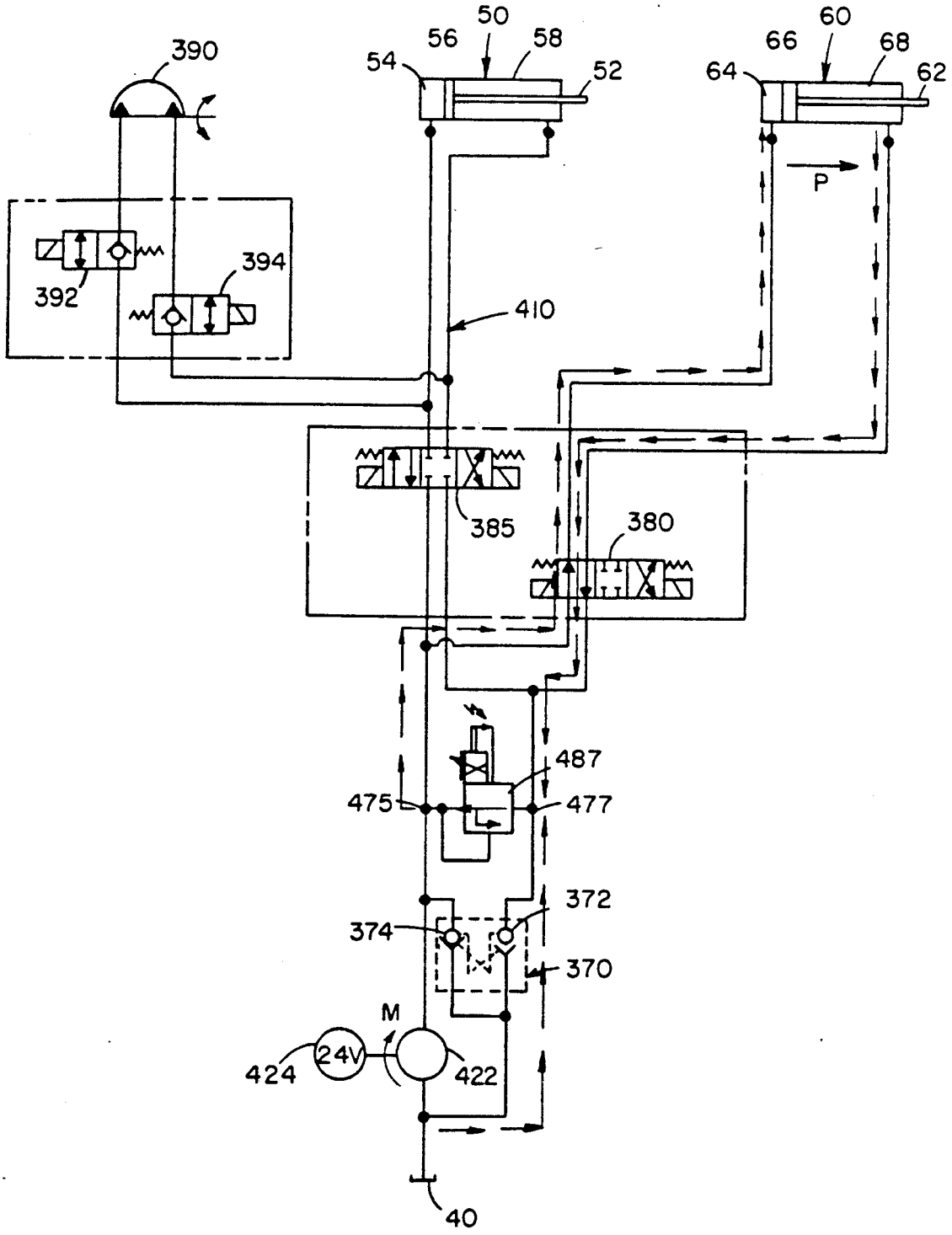
FIG. 32 is a schematic view of the hydraulic system of FIG. 27 wherein the hydraulic system is providing pressurized flow to the blind end of the leg hydraulics.

FIG. 31 shows the user successfully overcoming the pressure shown in FIG. 30 by moving the rod 52 and the piston 56 in the direction L. The pressure created by the user in the rod end 58 has overcome the tension in the proportional valve 487 and accordingly, fluid may flow through the valve 487 from the rod end 58 to the blind end 54 of the hydraulics 50. Because the blind end 54 requires more fluid as compared to the rod end 58 as the piston 56 is moved in the direction L, make-up fluid is channeled from the reservoir 40 via the unseated check valve 372 of the double pilot operated check valve 370. The check valve 372 is unseated by the pressure in port 475 created by the user. The direction of force from the system 410 is in the direction O and the direction of motion of the piston 56 is in the direction L.

Figure 33:
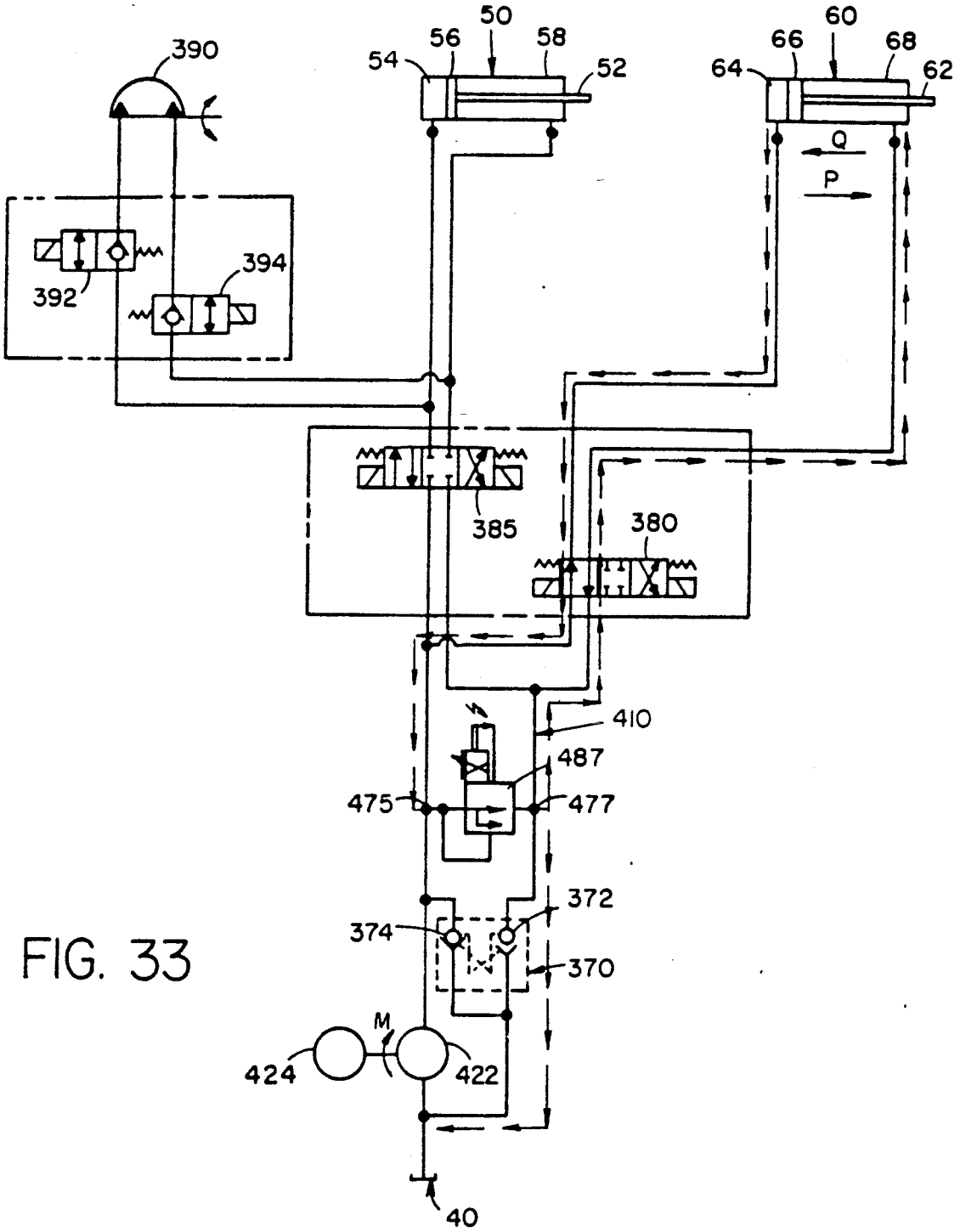
FIG. 33 is a schematic view of the hydraulic system of FIG. 27 wherein the user is successfully exercising against the pressurized flow of FIG. 32.
Figure 34:
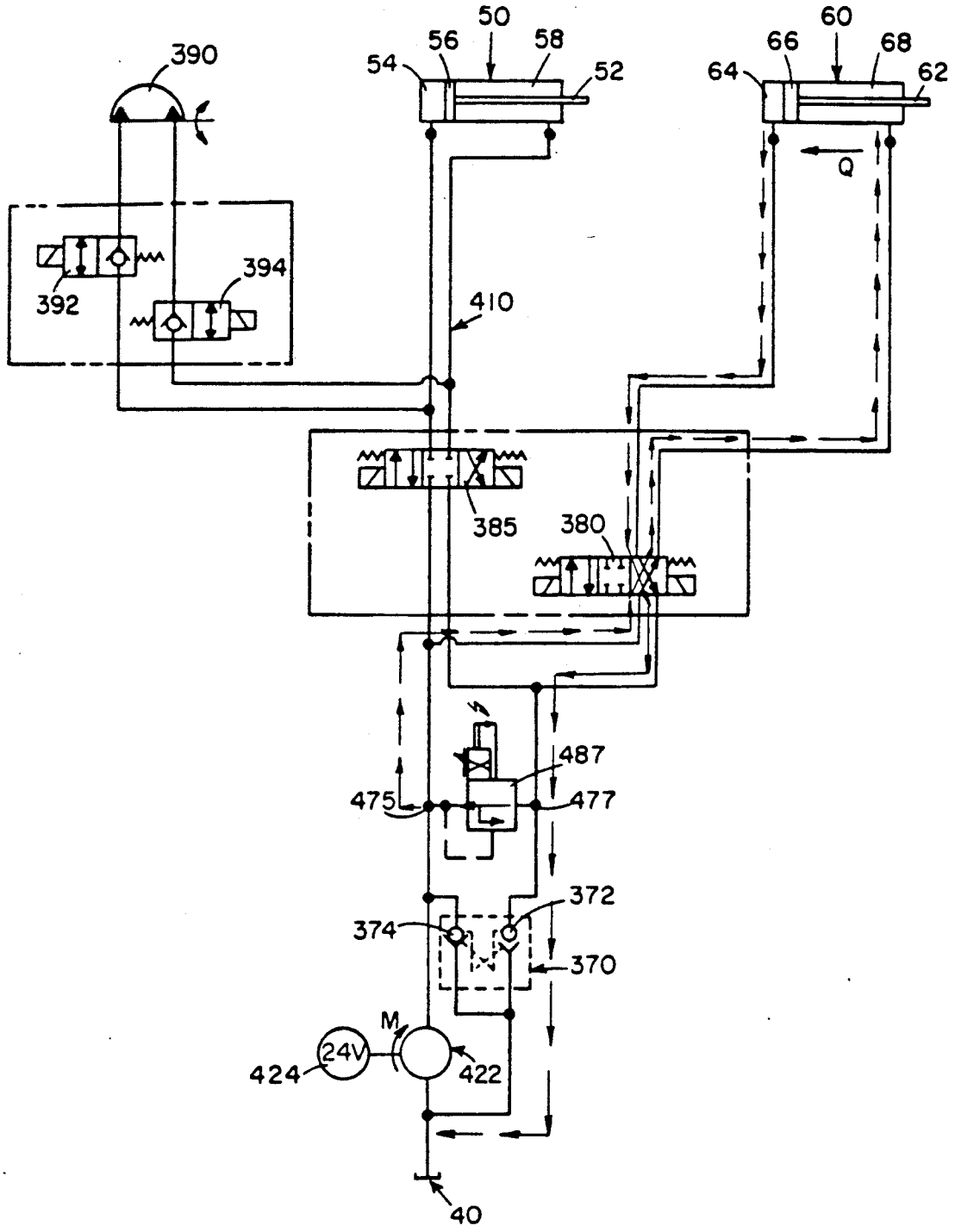
FIG. 34 is a schematic view of the hydraulic system of FIG. 27 wherein the system is providing pressurized flow to the rod end of the leg hydraulics.
Figure 35:
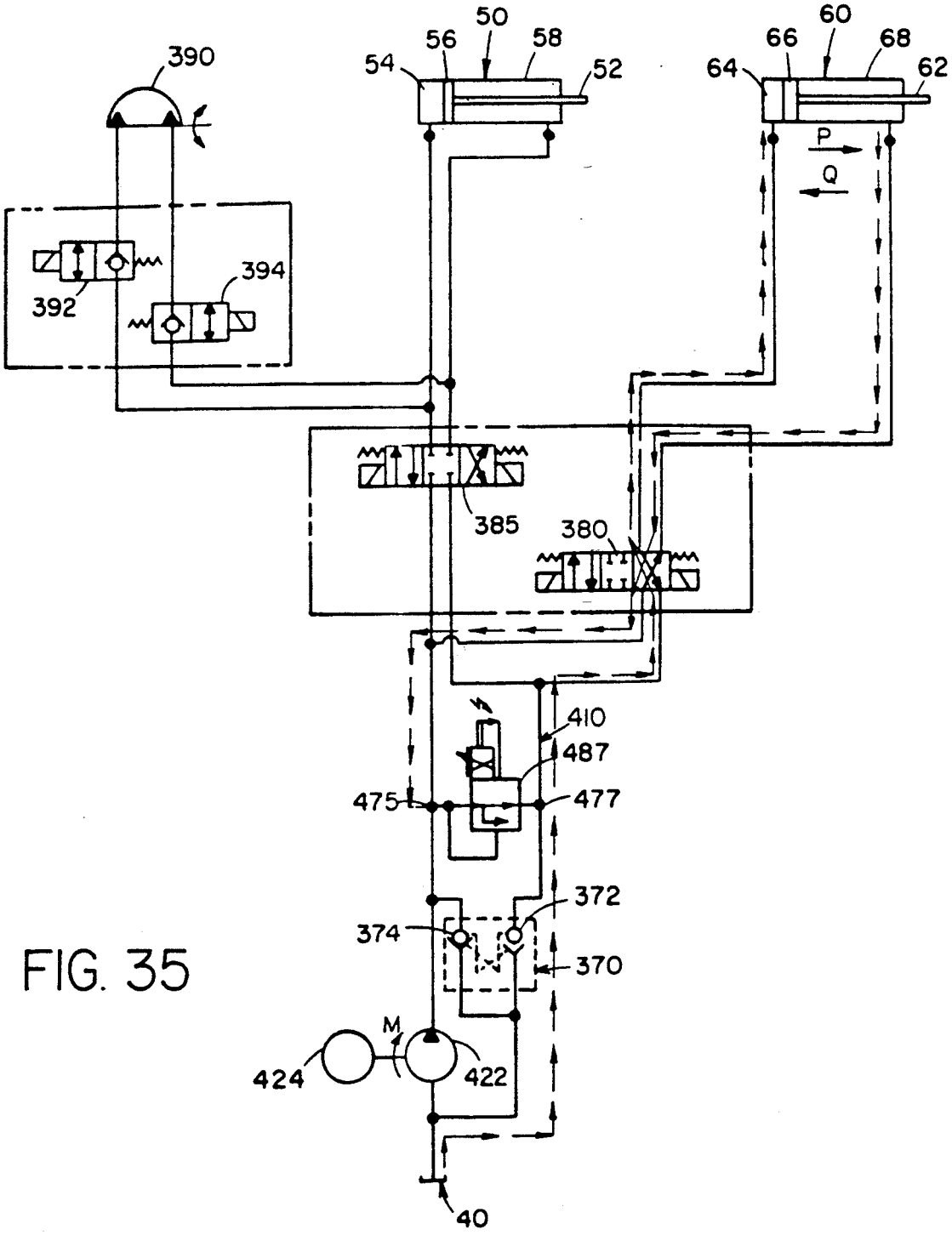
FIG. 35 is a schematic view of the hydraulic system of FIG. 27 wherein the user is successfully exercising against the pressurized flow of FIG. 34.

FIGS. 32 to 35 show the system 410 connected to the leg hydraulics 60 rather than to the arm hydraulics 50 as shown in FIGS. 27 to 30. Specifically, in FIG. 32 the control valve 385 is shut and the control valve 380 is open so that the blind end 64 of the leg hydraulics 60 is pressurized and connected to the valve 487 in a similar manner to FIG. 28 above (both force and motion in the direction P). In FIG. 33, the valve 385 is shut and the valve 380 is open so as to enable the user to exercise against the pressure of FIG. 32 in a similar manner to FIG. 29 above (force in direction P, motion in direction Q). In FIG. 34 the control valve 385 is shut and the control valve 380 is open to pressurize the rod end 68 of the leg hydraulics 60 in a manner similar to FIG. 30 above (both force and motion in direction Q). In FIG. 35 the control valve 385 is shut and the control valve 380 is open to enable the user to exercise against the pressure of FIG. 34 in a similar manner to FIG. 31 above (force in direction Q, motion in direction P). Thus, as shown in FIGS. 32 to 35 the leg hydraulics 60 can be connected to the valve 487 to perform the same functions as described above with regard to the arm hydraulics 50 in FIGS. 28 to 31. Accordingly, the pressure may be exerted by the system 410 either on the blind end 64 or the rod end 68 of the leg hydraulics 60 and the user may successfully overcome the pressure by moving the rod 62 and piston 66 against the pressure.

FIGS. 29, 31, 33 and 35 also show the configuration of the system 410 wherein the user is establishing the set point to begin exercising. The user grasps either the lever arm 12 or the lower body exerciser arm 13 and presses the set button. This elicits a command from the electronic controls 11 which instructs the arm 12 or 13 that it weighs zero pounds. This is accomplished by the system 410 sending pressurized flow to the appropriate end of either of the hydraulics 50 or 60 at the pressure necessary to compensate for the weight and friction from movement of the arm 12 or 13. At this time the user can, with little difficulty, move the rod 52 or 62 to the position of choice within the arm hydraulics 50 or leg hydraulics 60. At that point the user would disengage the set button and the set point would be achieved.

Figure 36:
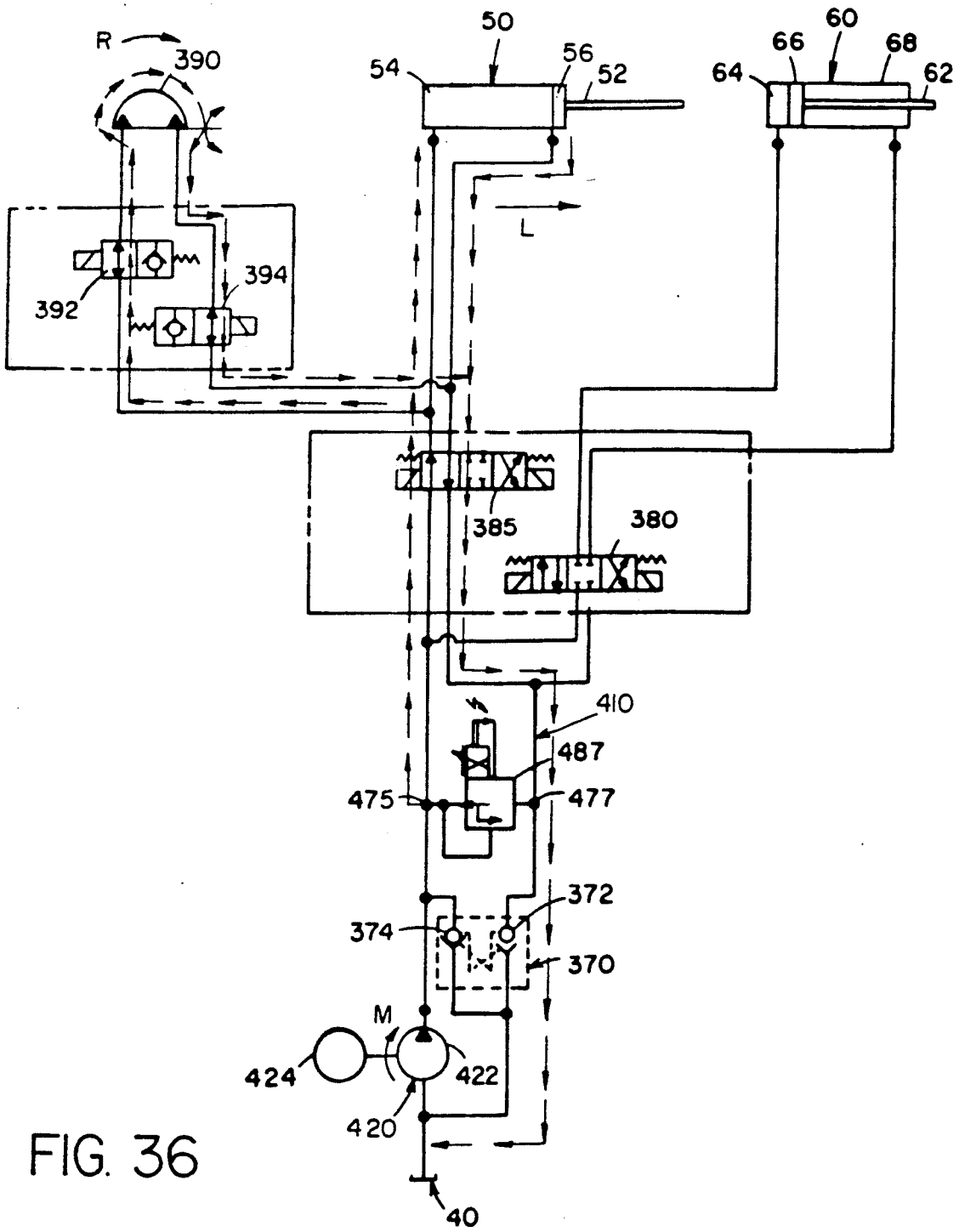
FIG. 36 is a schematic view of the hydraulic system of FIG. 27 rotating a rack and pinion actuator.

FIG. 36 shows the system 410 configured to move the rack and pinion actuator 390 in the direction R. The control valve 380 has shut the leg hydraulics 60 off from the pump 422 and the control valve 385 has connected the pump 422 to the blind end 54 of the arm hydraulics 50. As shown in FIG. 36, the rod 52 and piston 56 have been moved by the pressure exerted by the pump 422 in the direction L to their fully extended position and accordingly all pressure is now directed to the actuator 390. The actuator 390 has been opened to the pump 422 by the solenoid valves 392 and 394. The solenoid valves 392 and 394 have been opened by the electronic controls 11. Thus, the pump 422 is connected via the valve 392 to rotate the actuator 390 in the direction R as shown in FIG. 36. The actuator 390 can be made to rotate in the opposite direction by the system 410 by moving the valve 385 to the appropriate position so that the pump 422 is directed first to the control valve 394 and then to the actuator 390. This would enable the system 410 to move the actuator 390 in the opposite direction of R. In such an instance the rod 52 and piston 56 would be fully retracted in the direction opposite of L.

While the invention has been described in detail with respect to specific embodiments, it will be apparent to one skilled in the art that various changes and modifications can be made without departing from the spirit and scope thereof. For example, the present invention can be used in a number of different applications which take advantage of a number of hydraulic features described herein. For example, the device can be used in medical, occupational, or therapy applications. For example, those users that are overcoming specific injuries or disabilities can use the force generation system in accordance with occupational therapist requirements. The work-out related data can be analyzed by the occupational therapist or physician.

Another example is its use in robotics. In other words, the force generation and control system would allow a mechanism such as a robot to perform tasks based upon the amount of sensed pressure. For example, a gripping function can be performed by modulating the control force of the gripping element through the forced generation and control device.

The above description and drawings are only illustrative of preferred embodiments which achieve the objects, features and advantages of the present invention, and it is not intended that the present invention be limited thereto. Any modifications of the present invention which comes within the spirit and scope of the following claims is considered part of the present invention.

What is new and desired to be protected by U.S. Letters Patent is:

1. An exercise machine, comprising:

a base adapted to remain substantially stationary during use of the exercise machine;

a first hydraulic assembly, including a first cylinder having a first end and a second end, a first piston positioned within said first cylinder to move between said first and second first cylinder ends, and a first rod having an arm end and a piston end, wherein said piston end is connected to said first piston, said hydraulic assembly having a base end and being pivotally connected at its base end to said base;

said first arm pivotally connected to said base and pivotally connected to said arm end of said first rod so that as said first arm is pivoted with respect to said base, said first rod and said first piston move within said first cylinder;

first setting means for positioning said first rod and said first piston at a starting point within said first cylinder and simultaneously effecting a low resistance to movement of said first rod and said first piston within said first cylinder in a direction of movement either towards said first end or towards said second end of said first cylinder said first setting means further comprising a pump connected in series between said first end and said second end of said first cylinder, said pump having a first port and a second port, said first port and said second port connected to said first end and said second end respectively; and pressurizing means for providing pressurized fluid to a first end of said first cylinder thereby creating a high resistance to movement of said first piston and said first rod in said first cylinder in the direction of said first end once a starting point is set.

2. The exercise machine of claim 1 wherein said setting means includes an anticavitation system wherein the first end of the first cylinder is connected to the second end of the first cylinder through a first vented pilot operated relief valve and a first check valve connected in series, both the vented relief valve and the first check valve being opened by a back pressure caused by the movement of the first piston and first rod within the first cylinder.

3. The exercise machine of claim 1 wherein said pressurizing means includes a reservoir of fluid housed within the exercise machine and in fluid communication with a pump assembly, a second vented pilot operated relief valve connected in series between the pump assembly and the reservoir, and a first proportional pressure relief valve, connected to a second vented pilot operated relief valve by a first pilot line, such that when the first proportional pressure relief valve is opened, fluid flow in the first pilot line closes the second vented pilot operated relief valve and pressurized fluid is directed from the pump assembly to the first end of the first cylinder.

4. The exercise machine of claim 3 wherein said pressurizing means includes a first switching element connected in series between the pump assembly and the first end of the first cylinder and also connected to the first proportional pressure relief valve by a second pilot line, such that by opening the first proportional pressure relief valve, the first switching element is piloted open and the pressurized flow is directed from the pump assembly to the first end of the first cylinder.

5. The exercise machine of claim 3 wherein said pressurizing means includes a second proportional pressure relief valve in fluid communication with the second vented pilot operated valve through a third pilot line wherein the opening of the second proportional pressure relieving valve causes flow in the third pilot line and shuts the second pilot operated valve and thereby directs pressured fluid to the second end of the first cylinder.

6. The exercise machine of claim 5 wherein said pressurizing means includes a second switching element connected in series between the pump assembly and the second side of the first cylinder and further connected to the second proportional pressure relief valve through a fourth pilot line, whereby the opening of the second proportional pressure relief valve causes flow in the fourth pilot line which pilots open the second switching element and directs pressurized flow from the pump assembly to the second end of the first cylinder.

7. The exercise machine of claim 6 further comprising:

a second hydraulic assembly, including a second cylinder having a first end and a second end, a second piston positioned within said second cylinder to move between said first and second cylinder ends, and a second rod having a piston end and a base end and being pivotally connected at its base end to the base and pivotally connected at its piston end to the second piston;

a second lever pivotally connected to the base and pivotally connected to the second end of the second cylinder so that as the second lever is pivoted with respect to the base, the second rod and the second piston move within the second cylinder;

second setting means for positioning the second rod and second piston at a starting point within the second cylinder and simultaneously effecting a low resistance to movement of the second rod and second piston within the second cylinder in a direction of movement either towards said first or towards said second cylinder end; and switching means for directing the pressurized fluid to one of the ends of the second hydraulic assembly rather than one of the ends of the first hydraulic assembly, thereby pressurizing one end of the second cylinder.

8. The exercise machine of claim 7 wherein the switching means includes:

a first three-way directional valve connected at one end to the first switching element and connected at the other end to both first ends of the first and second hydraulics;

a second three-way directional valve connected at one end to the second switching element and connected at the other end to both second ends of the first and second hydraulics;

a solenoid valve connected at one end to the pump assembly and at the other end to the first and second three-way directional valves by a fifth pilot line so that when the solenoid valve is energized, hydraulic fluid flows in the fifth pilot line, the first and second three-way directional valves shift and the pressurized flow is directed through the first and second switching elements to the second hydraulics rather than the first hydraulics.

9. The exercise machine of claim 1 wherein said high resistance to movement results from movement of said arm causing said pressurized fluid to flow from said cylinder in a direction opposite to the direction in which said pump is driving.

10. The exercise machine of claim 9 wherein said pump is a bidirectional pump.

11. An exercise machine comprising:

a base adapted to remain substantially stationary during use said exercise machine;

a reservoir of hydraulic fluid housed within said base;

a first lever having a base end and an arm end, said first lever being pivotally connected at its base end to said base, said first lever being sized to be forced by a user of said exercise machine to pivot with respect to said base;

resistance means for selectively resisting the force supplied by such user to pivot said first lever with respect to said base; and setting means for enabling such user to position said first lever to a position to accommodate the physique of the user and the exercise to be performed before initiating the resistance means, in order that such user can pivot said lever with respect to said base while experiencing substantially small resistance wherein said setting means further comprises a pump connected in series between said first end and said second end of said first cylinder, said pump having a first port and a second port, said first port and said second port connected to said first end and said second end respectively; and wherein the resistance means comprises a first hydraulic assembly comprising a first cylinder having a first end and a second end, a piston; and a rod, wherein said hydraulic assembly has a lever end and a base end and is pivotally mounted at said lever end to said first lever and is pivotally mounted at said base end to said base so that as said lever is pivoted with respect to said base, said piston is moved linearly within said cylinder.

12. The machine of claim 11, wherein the setting means includes a vented pilot operated relief valve connected in series between the ends of the cylinder so that when the hydraulic fluid is evacuated from one end of the cylinder, the vented pilot operated relief valve is piloted open by the back pressure and the fluid may flow into the other end of the cylinder.

13. The machine of claim 12 wherein the setting means includes a check valve connected in series between the vented pilot operated relief valve and the other end of the cylinder so that when the hydraulic fluid is evacuated from one end of the cylinder, both the vented pilot operated relief valve and the check valve are opened by the back pressure and fluid may flow into the other end of the cylinder.

14. The machine of claim 11 wherein the setting means includes a pump connected in series between both sides of the cylinder so that as the user moves the piston towards one end of the cylinder, the pump directs pressurized flow to the end of the cylinder and at a pressure sufficient to compensate for the weight of the first lever and friction from pivoting of the lever.

15. The exercise machine of claim 14 wherein the pump is bidirectional.

16. The exercise machine of claim 15 wherein the setting means includes a double pilot operated check valve, having a port side and a check valve side, connected in parallel with the bidirectional pump to the ends of the cylinder on the port side and to the reservoir on the check valve side so that when the piston is being moved in the direction of the end of the cylinder bearing the rod, a check valve in the double pilot operated check valve is unseated by the back pressure and make-up fluid may flow from the reservoir, past the unseated valve and into the other end of the cylinder.

17. The exercise machine of claim 16 further comprising:

a second hydraulics assembly comprising a second cylinder with a first end and a second end which houses a second piston connected to a second rod, the second cylinder being pivotally connected at one end to the base;

a second lever pivotally connected to the base and also pivotally connected to the other end of the second hydraulics assembly so that as the second lever is pivoted with respect to the base the second rod and piston move within the second cylinder;

second setting means for positioning the second rod and second piston at a starting point within the second cylinder while encountering minimal resistance to movement of the second rod and second piston within the second cylinder in both directions of movement;

switching means for directing the pressurized flow to one of the ends of the second hydraulics rather than one of the ends of the first hydraulics, thereby pressurizing one end of the second cylinder.

18. The exercise machine of claim 17 wherein the switching means includes a first control solenoid valve, connected at one end to the pump assembly and connected at the other end to both first ends of the first and second hydraulics, and a second control solenoid valve, connected at one end to the pump assembly and connected at the other end to both second ends of the first and second hydraulic assemblies such that when the first and second control solenoid valves are energized, the first and second control valves shift and the pressurized flow is directed through the first and second directional control valves to the second hydraulics rather than the first hydraulics.

19. The exercise machine of claim 11 wherein the setting means includes a proportional pressure relief valve connected in series between both ends of the cylinder, a pump having a reservoir end and a valve end and connected to the reservoir at its reservoir end and one end of the proportional pressure relief valve at its valve end so that the pump and the proportional pressure relief valve direct pressurized flow to the end of the cylinder and at a pressure sufficient to compensate for the weight of the first lever and friction from pivoting of the lever, enabling the user to pivot the arm with respect to the base while encountering minimal resistance.

20. The machine of claim 19 wherein said setting means includes a double pilot operated check valve having a port side and a check valve side and connected in parallel on its port side with the proportional pressure relief valve and the ends of the cylinder and connected on its check valve side to the reservoir so that when the piston is being moved in the direction of the end of the cylinder bearing the rod, a check valve in the double pilot operated check valve is unseated by the back pressure and make-up fluid may flow from the reservoir, past the unseated check valve and into the other end of the cylinder.

21. The exercise machine of claim 20 further comprising:

a second hydraulics assembly comprising a second cylinder with a first end and a second end which houses a second piston connected to a second rod, the second cylinder being pivotally connected at one end to the base;

a second lever pivotally connected to the base and also pivotally connected to the other end of the second hydraulics assembly so that as the second lever is pivoted with respect to the base the second rod and piston move within the second cylinder;

second setting means for positioning the second rod and second piston at a starting point within the second cylinder while encountering minimal resistance to movement of the second rod and second piston within the second cylinder in both directions of movement;

switching means for directing the pressurized flow to one of the ends of the second hydraulics rather than one of the ends of the first hydraulics, thereby pressurizing one end of the second cylinder.

22. The exercise machine of claim 21 wherein the switching means includes a first control solenoid valve, connected at one end to the port side of the double pilot operated check valve and connected at the other end to both the first and second end of the first hydraulics, and a second control solenoid valve, connected at one end to the port side of the double pilot operated check valve and connected at the other end to both the first and second ends of the second hydraulics such that when the first control solenoid valve is energized open and the second control solenoid valve is energized shut, pressurized flow is directed to the first hydraulics and when the first control solenoid valve is energized shut and the second control solenoid valve is energized open, pressurized flow is directed to the second hydraulics.

23. The exercise machine of claim 11 wherein resistance to the force supplied by said user is accomplished by movement of said lever causing said hydraulic fluid to flow from said cylinder in a direction opposite to the direction said pump is driving.

24. The exercise machine of claim 23 wherein said pump is a bidirectional pump.

25. An exercise machine, comprising:

a base adapted to remain substantially stationary during use of the machine;

a reservoir of hydraulic fluid housed with said base;

a lever having a base end and an arm end, said lever being pivotally connected at its base end to said base;

moving means for pivoting said lever with respect to said base, said moving means comprising a hydraulic assembly, having a cylinder, piston and rod, and a base end and lever end, said cylinder having a first end and a second end, said hydraulic assembly being pivotally connected to said base at its base end and pivotally connected to said lever at its lever end so that when said lever is pivoted with respect to said base, said piston moves linearly with respect to said hydraulic assembly; and pressurizing means for directing a pressurized flow of fluid into either said first end or said second end of said cylinder at the pressure and quantity necessary to pivot said lever with respect to said base with a force desired and in the direction and speed desired by a user;

wherein said pressurizing means includes a pump connected in series between said first end and said second end of said cylinder, said pump having a first port and a second port, said first port and said second port being connected to said first end and said second end respectively.

26. The exercise machine of claim 25 wherein the pressurizing means includes a pump and a first normally closed switching element connected in series between the reservoir and the first end of the cylinder so that when the pump is energized and when the normally closed switching element is open, pressurized flow at the pressure set by the pilot flow to the first normally closed switching element will be directed to the first end of the cylinder.

27. The exercise machine of claim 26 wherein the pressurizing means includes a second normally closed switching element connected in series between the pump and the second end of the cylinder so that when the second normally closed switching element is open, pressurized flow at the pressure set by the pilot flow to the second normally closed switching element will be directed to the second end of the cylinder.

28. The exercise machine of claim 27 wherein the pressurizing means includes a first proportional pressure relief valve connected to the pump in parallel with the first normally closed switching element, and the first proportional pressure relief valve directing flow to the first normally closed switching element.

29. The exercise machine of claim 28 wherein the pressurizing means includes a second proportional pressure relief valve connected to the pump in parallel with the second normally closed switching element and the second proportional pressure relief valve directing flow to the second normally closed switching element.

30. The exercise machine of claim 29 further comprising:

a second lever pivotally connected to the base;

a second hydraulic assembly having a second cylinder, a second rod and a second piston, and a base end and a lever end, being pivotally attached to the base at its base end and pivotally attached to the second lever at its lever end, so that as the second lever is pivoted with respect to the base, the second piston is moved linearly within the second cylinder; and switching means to switch the pressurized flow from the first hydraulics to the second hydraulics, the switching means including:

a first three-way directional valve connected at one end to the first switching element and connected at the other end to both second ends of the first and second hydraulics;

a second three-way directional valve connected at one end to the second switching element and connected at the other end to both second ends of the first and second hydraulics;

a solenoid valve connected at one end to the pump assembly and at the other end to the first and second three-way directional valves by a pilot line so that when the solenoid valve is energized, hydraulic fluid flows in the pilot line, the first and second three-way directional valves shift and the pressurized flow is directed through the first and second switching elements to the second hydraulics rather than the first hydraulics.

31. The exercise machine of claim 25 wherein said pump is a bidirectional pump.

32. An exercise machine, comprising:

a base adapted to remain substantially stationary during use of said exercise machine;

a reservoir of hydraulic fluid housed within said base;

a first lever having a base end and an arm end, said first lever being pivotally connected at its base end to said base, said first lever being sized to be forced by a user of said exercise machine to pivot with respect to said base;

resistance means for selectively resisting a force supplied by such user to pivot said first lever with respect to said base;

setting means for enabling such user to position said first lever to a position to accommodate the physique of said user and the exercise to be performed before initiating said resistance means, in order that such user can pivot said lever with respect to said base while experiencing little resistance;

wherein said resistance means comprises a first hydraulic assembly comprising a first cylinder having a first end and a second end;

a piston; and a rod, wherein said hydraulic assembly has a lever end and a base end and is pivotally mounted at said lever end to said first lever and is pivotally mounted at said base end to said base so that as said lever is pivoted with respect to said base, said piston is moved linearly within said cylinder;

wherein said setting means includes a pump connected in series between both end of said first cylinder, said pump having a first port and a second port, said first port connected to said first end of said first cylinder, said second port connected to said second end of said first cylinder, so that as such user moves said piston towards one end of said first cylinder, said pump directs pressurized flow to the other end of said first cylinder at a pressure sufficient to compensate for the weight of said first lever and friction from pivoting of said lever.

33. The exercise machine of claim 32 wherein said pump is bidirectional.

34. The exercise machine of claim 33 wherein said setting means includes a double pilot operated check valve, having a port side and a check valve side connected in parallel with said bidirectional pump.

35. The exercise machine of claim 34, wherein said double pilot operated check valve is connected on said port side to said cylinder and on its said check valve side to said reservoir so that when said piston is being moved in the direction of the end of said cylinder bearing said rod, a check valve in said double pilot operated check valve is unseated by the back pressure and make-up fluid may flow from said reservoir, past said unseated valve and into the other end of said cylinder.

36. The exercise machine of claim 35 further comprising:

a second hydraulics assembly comprising a second cylinder with a first end and a second end which houses a second piston connected to a second rod, said second cylinder being pivotally connected at one end to said base;

a second lever pivotally connected to said base and also pivotally connected to the other end of said second hydraulics assembly so that as said second lever is pivoted with respect to said base, said second rod and piston move within said second cylinder;

second setting means for positioning said second rod and second piston at a starting point within said second cylinder while encountering minimal resistance to movement of said second rod and second piston within said second cylinder in both directions of movement; and switching means for directing said pressurized flow to one of the ends of said second hydraulic assembly rather than one of the ends of said first hydraulic assembly, thereby pressurizing one end of said second cylinder.

37. The exercise machine of claim 36 wherein said switching means includes a first control solenoid valve, connected at one end to said pump and connected at the other end to said first ends of said first and second hydraulic assemblies, and a second control solenoid valve, connected at one end to said pump and connected at the other end to said second ends of said first and second hydraulic assemblies such that when said first and second control solenoid valves are energized, said first and second control valves shift and said pressurized flow is directed through said first and second directional control valves to said second hydraulic assembly rather than said first hydraulic assembly.

38. The exercise machine of claim 32 wherein resistance to the force supplied by said user is accomplished by movement of said lever causing said hydraulic fluid to flow from said cylinder in a direction opposite to the direction said pump is driving.

39. An hydraulic machine, comprising:

a base adapted to remain substantially stationary during use of said machine;

a first hydraulic assembly, including a first cylinder having a first end and a second end, a first piston positioned within said first cylinder to move between said first and second first cylinder ends, and a first rod having an arm end and a piston end, wherein said piston end is connected to said first piston, said hydraulic assembly having a base end and being pivotally connected at its base end to said base;

said first arm pivotally connected to said base and pivotally connected to said arm end of said first rod so that as said first arm is pivoted with respect to said base, said first rod and said first piston move within said first cylinder;

first setting means for positioning said first rod and said first piston at a starting point within said first cylinder and simultaneously effecting a low resistance to movement of said first rod and said first piston within said first cylinder in a direction of movement either towards said first end or towards said second end of said first cylinder, said first setting means further comprising a pump connected in series between said first end and said second end of said second end of said first cylinder, said pump having a first port and a second port, said first port and said second port connected to said first end and said second end respectively; and pressurizing means for providing pressurized fluid to a first end of said first cylinder thereby created a high resistance to movement of said first piston and said first rod in said first cylinder in the direction of said first end once a starting point is set.

* * * * *